US009424775B2

(12) United States Patent
Lau et al.

(10) Patent No.: US 9,424,775 B2
(45) Date of Patent: Aug. 23, 2016

(54) LEDOS PROJECTION SYSTEM

(71) Applicant: The Hong Kong University of Science and Technology, Kowloon (HK)

(72) Inventors: Kei May Lau, Kowloon (HK); Chik Yue, Kowloon (HK); Zhaojun Liu, New Territories (HK)

(73) Assignee: THE HONG KONG UNIVERSITY OF SCIENCE AND TECHNOLOGY, Kowloon (HK)

( * ) Notice: Subject to any disclaimer, the term of this patent is extended or adjusted under 35 U.S.C. 154(b) by 227 days.

(21) Appl. No.: 14/054,641

(22) Filed: Oct. 15, 2013

(65) Prior Publication Data

US 2014/0111408 A1 Apr. 24, 2014

Related U.S. Application Data

(60) Provisional application No. 61/795,336, filed on Oct. 15, 2012.

(51) Int. Cl.
*G09G 3/00* (2006.01)
*G09G 3/32* (2016.01)

(52) U.S. Cl.
CPC ..... *G09G 3/3241* (2013.01)

(58) Field of Classification Search
CPC ..... G09G 3/3406; G09G 3/3648
USPC ..... 345/32, 39, 40, 83; 438/460, 462, 458; 257/678
See application file for complete search history.

(56) References Cited

U.S. PATENT DOCUMENTS

| | | | | |
|---|---|---|---|---|
| 7,375,650 | B2 | 5/2008 | Lo | |
| 8,324,082 | B1 * | 12/2012 | Liu et al. | 438/460 |
| 2001/0017604 | A1 * | 8/2001 | Jacobsen | G02B 25/002 345/27 |
| 2002/0008637 | A1 | 1/2002 | Lemelson et al. | |
| 2004/0212309 | A1 | 10/2004 | St.-Germain | |
| 2005/0206529 | A1 | 9/2005 | St.-Germain | |
| 2006/0197684 | A1 | 9/2006 | Tremblay | |
| 2008/0238720 | A1 | 10/2008 | Lee | |
| 2009/0167561 | A1 | 7/2009 | Liang | |
| 2010/0165660 | A1 * | 7/2010 | Weber et al. | 362/609 |
| 2011/0309378 | A1 * | 12/2011 | Lau et al. | 257/88 |

OTHER PUBLICATIONS

Akanegawa, et al., "Basic Study on Traffic Information System Using LED Traffic Lights", IEEE Transactions on Intelligent Transportation System, vol. 2, No. 4, Dec. 2001, 7 pages.

Wada, et al., "Road-to-Vehicle Communication Using LED Traffic Light." IEEE Intelligent Vehicles Symposium Proceedings, Jun. 2005, 6 pages.

* cited by examiner

*Primary Examiner* — Calvin C Ma
(74) *Attorney, Agent, or Firm* — Amin, Turocy & Watson, LLP

(57) ABSTRACT

Image projection utilizing light-emitting diodes on a silicon (LEDoS) substrate is described herein. LEDoS devices selectively activate LED pixels to produce light. Light can excite color conversion materials of the LEDoS devices to form color images. Images can be projected onto a projection surface.

34 Claims, 17 Drawing Sheets

LEDOS PROJECTION SYSTEM

CROSS REFERENCE TO RELATED APPLICATION

This application claims priority to U.S. provisional application No. 61/795,336, filed on Oct. 15, 2012 and entitled: "Intelligent Traffic Light (iTL) with LEDoS Projection System." The entirety of this provisional application is incorporated herein by reference.

TECHNICAL FIELD

This disclosure generally relates to a light emitting diode on silicone (LEDoS) projection system, e.g., multi-color LEDoS prism-based projection system and related embodiments.

BACKGROUND

The global high-brightness (HB) LED market grew 93% from $5.6 B in 2009 to $10.8 B in 2010, according to market research firm Strategies Unlimited after analyzing market demand as well as the supply-side activity of more than 40 HB-LED component suppliers. LCD monitor and TV backlights led the growth spurt, followed by mobile display applications.

The replacement of incandescent light bulbs in traffic lights around the world is arguably the first large-scale deployment of LEDs. According the Department of Transportation in California and Arizona, USA, the cost of electricity consumed in operating signalized intersection 24 hours a day averages about US$1,000 per year. The electricity bill is about 8-10× lower using the LED lights. Figuring in the periodic maintenance cost of bulb replacement during light traffic hours, the somewhat higher initial cost of LED traffic lights can be paid back in 12-18 months. This one of the main reason behind the early adoption of LED in traffic light by cities around the world.

In the future, to build a sustainable environment, electronic systems for our civil infrastructure, such as the traffic lights, must be advanced in several aspects. Specifically, they should be: manufactured efficiently to reduce e-waste: multi-functional systems for providing more functionality with less raw materials; deployed efficiently to eliminate redundant installation for different purposes; operated efficiently so that the same energy can be reused to perform vital functions for our ecosystem.

The above-described background is merely intended to provide an overview of contextual information regarding networks, and is not intended to be exhaustive. Additional context may become apparent upon review of one or more of the various non-limiting embodiments of the following detailed description.

BRIEF DESCRIPTION OF THE DRAWINGS

Numerous aspects and embodiments are set forth in the following detailed description, taken in conjunction with the accompanying drawings, in which like reference characters refer to like parts throughout, and in which.

DETAILED DESCRIPTION

Figure 1:
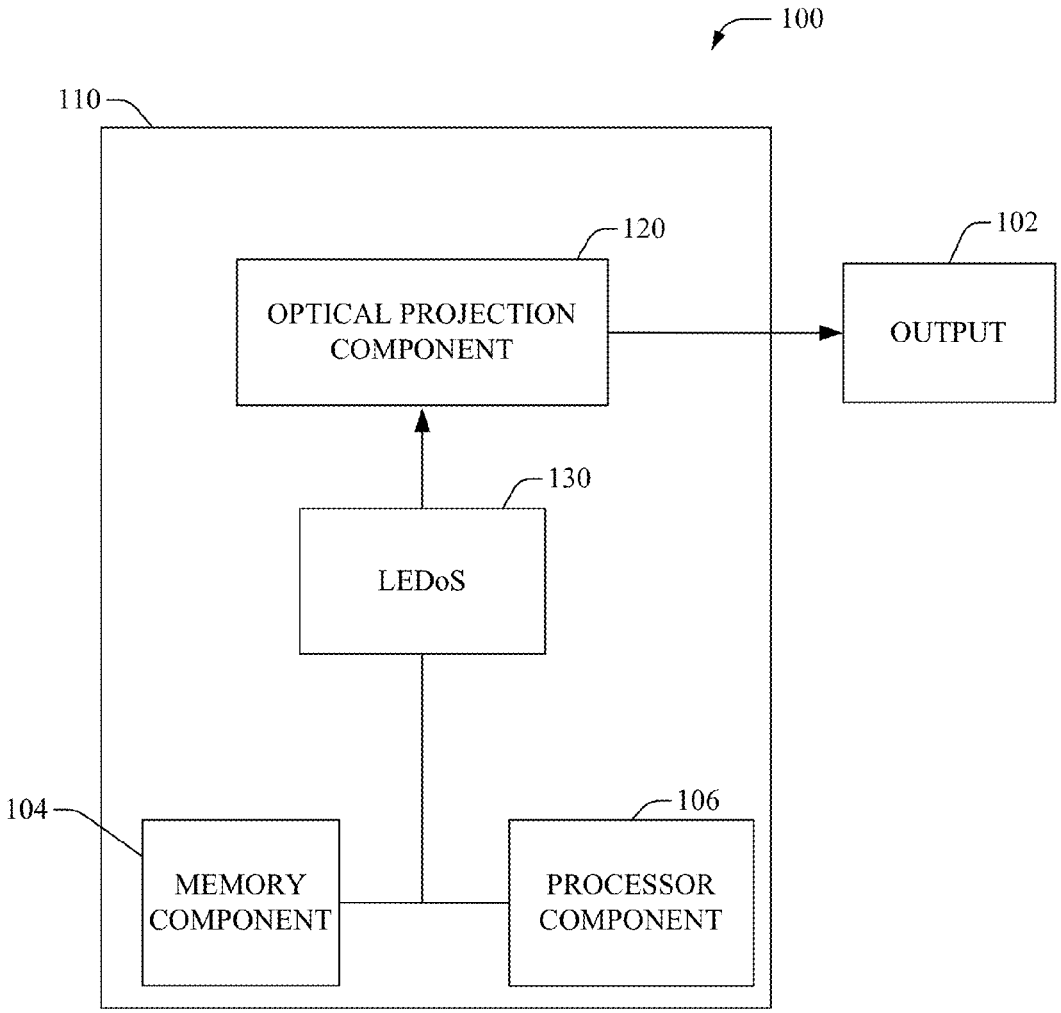
FIG. 1 is an example functional high level block diagram of a system that facilitates LEDoS prism based projection of an image, according to an aspect or embodiment of the subject disclosure.

Various aspects or features of this disclosure are described with reference to the drawings, wherein like reference numerals are used to refer to like elements throughout. In this specification, numerous specific details are set forth in order to provide a thorough understanding of this disclosure. It should be understood, however, that the certain aspects of disclosure may be practiced without these specific details, or with other methods, components, molecules, etc. In other instances, well-known structures and devices are shown in block diagram form to facilitate description and illustration of the various embodiments. Additionally, elements in the drawing figures are not necessarily drawn to scale; some areas or elements may be expanded to help improve understanding of certain aspects or embodiments.

Furthermore, the terms "real-time," "near real-time," "dynamically," "instantaneous," "continuously," and the like are employed interchangeably or similarly throughout the subject specification, unless context warrants particular distinction(s) among the terms. It should be noted that such terms can refer to data which is collected and processed at an order without perceivable delay for a given context, the timeliness of data or information that has been delayed only by the time required for electronic communication, actual or near actual time during which a process or event occur, and temporally present conditions as measured by real-time software, real-time systems, and/or high-performance computing systems.

"Logic" as used herein and throughout this disclosure, refers to any information having the form of instruction signals and/or data that may be applied to direct the operation of a processor. Logic may be formed from signals stored in a device memory. Software is one example of such logic. Logic may also be comprised by digital and/or analog hardware circuits, for example, hardware circuits comprising logical AND, OR, XOR, NAND, NOR, and other logical operations. Logic may be formed from combinations of software and hardware. On a network, logic may be programmed on a server, or a complex of servers. A particular logic unit is not limited to a single logical location on the network.

Systems and methods presented herein relate to image projection utilizing LEDoS circuitry and/or electronic chips. In an aspect, LEDoS systems can be referred to as micro systems and/or as having micro displays. It is noted that micro can relate to a relative size of a display and/or components.

In an aspect, an LEDoS system can generate an image based on output from LED pixels of the LEDoS system. A controller, such as a computer processor, can provide instructions to selectively activate pixels of the LEDoS system. The controller can provide instructions to form an image, such as an image stored in a memory. The image can be received by a projection screen and/or projected by a lens. In an aspect, a projection lens and/or projection screen can magnify the image to a desired size.

FIG. 1 is an example functional high level block diagram of a system 100 that facilitates LEDoS prism based projection. While the various components are illustrated as separate components, it is noted that the various components can be comprised in one or more other components. Further, it is noted that the system 100 can comprise additional components not shown for readability. Additionally, various aspects described herein may be performed by one device or on a number of devices in communication with each other. It is further noted that system 100 can be within larger networked environments. In implementations, system 100 can comprise an LEDoS projection device 110 that generates output 102. LEDoS projection device 110 can primarily comprise optical projection component 120 that projects output 102 and LEDoS component 130 that can generate an image.

In an aspect, LEDoS projection device 110 can further comprise memory component 104 and processing component 106 (e.g., a controller). Memory component 104 can comprise one or more memory devices. It is noted that memory component 104 can comprise various types of non-transitory computer readable storage devices. Further, processing component 106 can comprise a computer processor or the like. In an aspect, memory component 104 can store computer executable components and/or instructions for components. In another aspect, processing component 118 can execute the computer executable components and/or facilitate implementation of the components.

It is noted that the system 100 can be comprised in various other systems such as intelligent traffic light (iTL) systems and the like. For example, system 100 can comprise various devices such as smart phones, tablets, e-readers, digital video recorders, mobile music players, personal computers, set top boxes, cameras, digital video recorders (DVRs), consumer electronics and the like. LEDoS projection device 110 can communicate data signals with network devices. The signal can comprise data representing instructions to form images.

In an implementation, LEDoS component 130 can comprise one or more LEDoS chips. In some implementations, the LEDoS chip can comprise gallium nitride (GaN) based LED's on a wafer surface. It is noted that the wafer can comprise sapphire, silicon, silicon carbide substrates, and the like. In an aspect, the LEDoS chip can comprise a flip-chip mounted active matrix (AM) and/or passive matrix micro array (μ-array) chip and the like. In some implementations, the LEDoS component 130 can comprise an AM panel fabricated on silicon using a complementary metal-oxide-semiconductor (CMOS) construction processes, with the monolithic LED array flipped on a top side of the chip.

LEDoS component 130 can generate images utilizing an array of LED elements. In an aspect, the LEDoS component 130 can render a predetermined image and/or a dynamically determined image based on one or more instructions. It is noted that LEDoS component 130 can blend or convert various LED sources to generate the image as a full color image or can comprise a monochromatic LEDoS component that generates images of one color. In another aspect, LEDoS component 130 can comprise multiple monochromatic or full color LEDoS chips.

Optical projection component 120 can receive an image or series of images from LEDoS component 130, and generate output 102. In an aspect, optical projection component 120 can magnify, enlarge, and/or focus received images. In another aspect, optical projection component 120 can facilitate transmission of the image onto a projection receiving surface. It is noted that optical projection component 120 can comprise various optical lenses, digital projection components, minors, and the like.

In an aspect, optical projection component 120 can comprise one or more projection components (e.g., lenses). In an implementation, optical projection component 120 comprises a lens for each LEDoS chip of LEDoS component 130.

Figure 2:
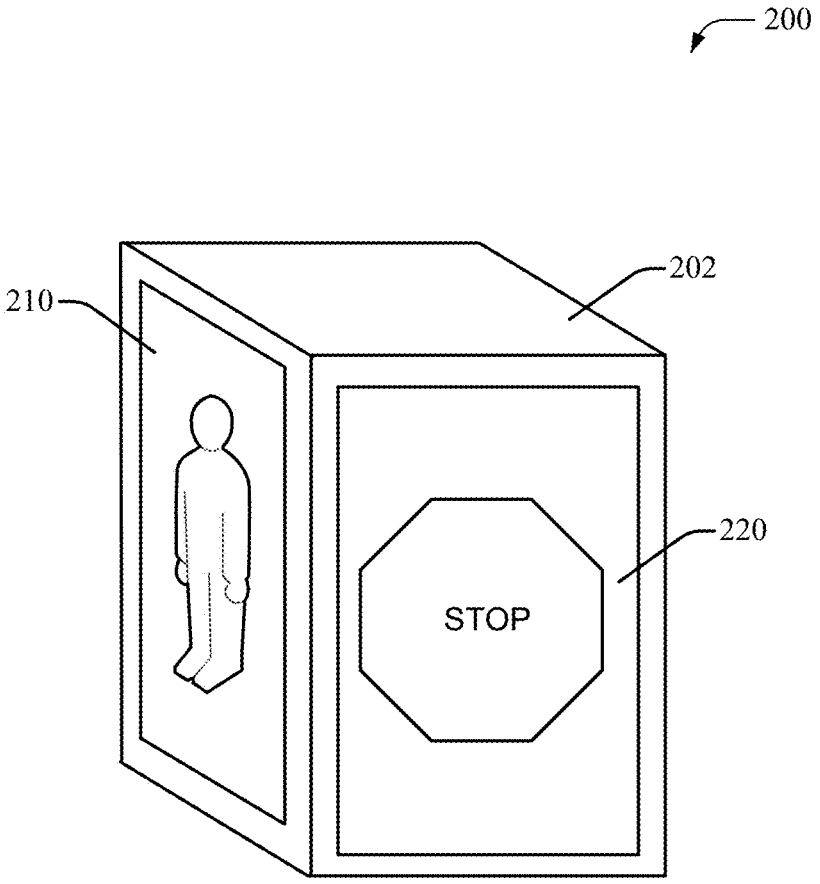
FIG. 2 is an example functional high level block diagram of a system that facilitates LEDoS prism based projection of an image including multiple display surfaces, according to an aspect or embodiment of the subject disclosure.

FIG. 2 is an example non-limiting system 200 for a multi-display optical projection system in accordance with an exemplary embodiment of this disclosure. The system 200 can include casing 202 that comprises a frame or housing for various components, a first projection surface 210 for displaying a first image, and a second projection surface 220 for displaying a second image. While only two projection surfaces are shown, it is noted that system 200 can comprise virtually any number of projection surfaces. Additionally, while casing 202 is shown as a three dimensional rectangular prism it is noted that casing 202 can comprise virtually any shape capable of providing a housing for components of system 200. Further, it is noted that the casing 202 can be of a singular construction and/or can comprise various components removably connected to form casing 202. Additionally, the various components can be contained in one or more devices, or on a number of individual device in communication with each other.

Projection surface 210 and projection surface 220 can comprise an opaque and/or semi-opaque material capable of receiving a projection image. The image can be generated and/or projected by internal components housed in casing 202. With reference to FIG. 1, LEDoS 130 can generate an image and optical projection component 110 can project the image onto projection surface 210 and/or projection surface 220. It is noted that optical projection surface 110 can project disparate images and/or a common image onto projection surface 210 and/or projection surface 220. For example, system 200 can comprise an iTL having four projection surfaces. Each surface can receive an image, generated by LEDoS 130, that comprises an image for traffic direction.

In some embodiments, projection surface 210 and projection surface 220 can be detached from system 200. Accordingly, projection surface 210 and 220 can comprise virtually any surface capable of receiving a projection. As an example, projection surface 210 and/or projection surface 220 can comprise a wall, a screen (e.g., canvas screen), a street, and the like.

In embodiments, system 200 can comprise a consumer electronics device. For example, system 200 can comprise a smart phone, a set top box, a laptop computer, a desktop computer, and the like.

It is noted that the transistors can comprise a p-channel Metal Oxide Semiconductor (PMOS) transistor, an n-channel Metal Oxide Semiconductor (NMOS) transistor, an n-type amorphous silicon Thin Film Transistor (n-type a-Si TFT), a p-type amorphous silicon Thin Film Transistor (p-type a-Si TFT), an n-type poly crystalline silicon Thin Film Transistor (n-type p-Si TFT), a p-type poly crystalline silicon Thin Film Transistor (p-type p-Si TFT), an n-type Silicon On Insulator (SOI) transistor, or a p-type SOI transistor.

Figure 3:
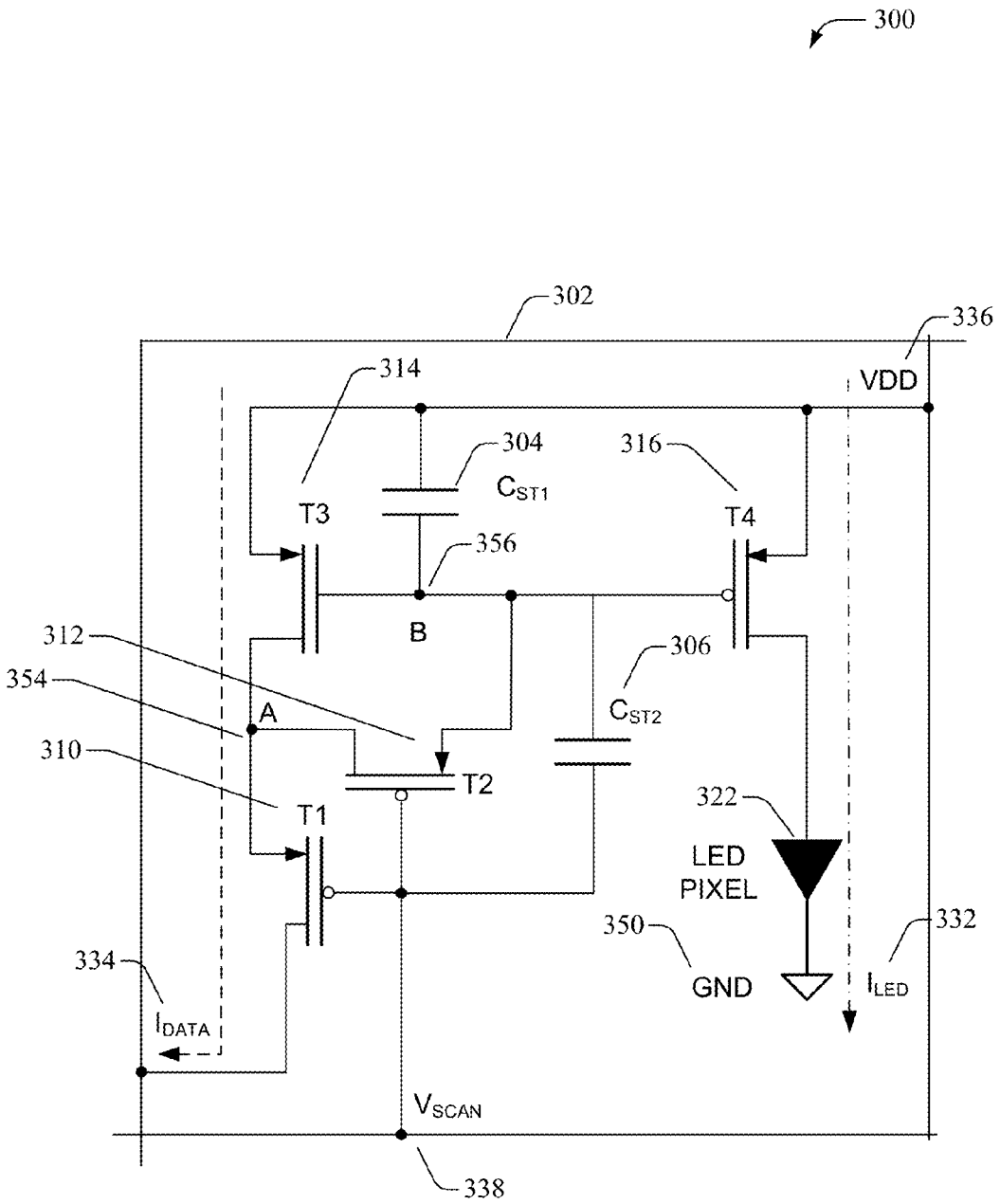
FIG. 3 is an example functional high level block diagram of a system that facilitates LEDoS prism based projection of an image including a driving circuit, according to an aspect or embodiment of the subject disclosure.

FIG. 3 is an example non-limiting system 300 for a circuit diagram of an LEDoS of an optical projection system in accordance with an exemplary embodiment of this disclosure. The system 300 can comprise a driving circuit 302 formed on a substrate such as silicon. Driving circuit 302 can primarily comprise switching transistors (T1 310 and T2 312), mirror transistor (T3 314), storage capacitors ($C_{ST1}$ 304, $C_{ST2}$ 306), a drain terminal with a transistor (T4 316), LED pixels 322, and ground 350. It is noted that signals $V_{scan}$ 338, $I_{data}$ 334, and positive supply voltage (VDD 336) can be applied by one or more voltages sources. While FIG. 3 depicts driving circuit 302 in an exemplary construction, it is noted that various other embodiments can comprise similar circuitry to produce substantially similar results as driving circuit 302.

In an aspect, $C_{ST1}$ 304 and $C_{ST2}$ 306 can be connected between a scan line ($V_{scan}$ 338) and VDD 336. It is noted that $C_{ST1}$ 304 and $C_{ST2}$ 306 can be in a cascading structure. Further LED pixels 322 can be connected between a drain terminal of T4 316 and ground 350. It is noted that an anode and a cathode of LED pixels 122 can be respectively connected between drain terminal of T4 316 and ground 350.

In embodiments, driving circuit 302 can be controlled to be in an on state and/or an off state. In an on state $V_{scan}$ 338 can switch T1 310 and T2 312 into an on position. In another aspect $I_{data}$ 334 can pass through T1 310 and T3 314, as depicted by the dashed line of $I_{data}$ 334. Further a voltage at T2 312 can be accumulated at node A 354. Concurrently or substantially concurrently, a voltage at node B 356 (e.g., gate terminal of T3 314) can be accumulated and controlled by $I_{data}$ 334 passing through T3 314. In an aspect, $I_{data}$ 334 can comprise a current from a current source. $I_{data}$ 334 can be generated such that a gate voltage of T3 314 is within a range such that a defined amount of current (e.g., $I_{data}$ 334) flows through T1 310 and T2 312. A current passing through the LED pixels 322 can be controlled by a geometry ratio of T3 314 and T4 316 to maintain a relationship of $$I_{LED-ON} / I_{data} = \frac{W_{T4} / L_{T4}}{W_{T3} / L_{T3}}.$$

Figure 4:
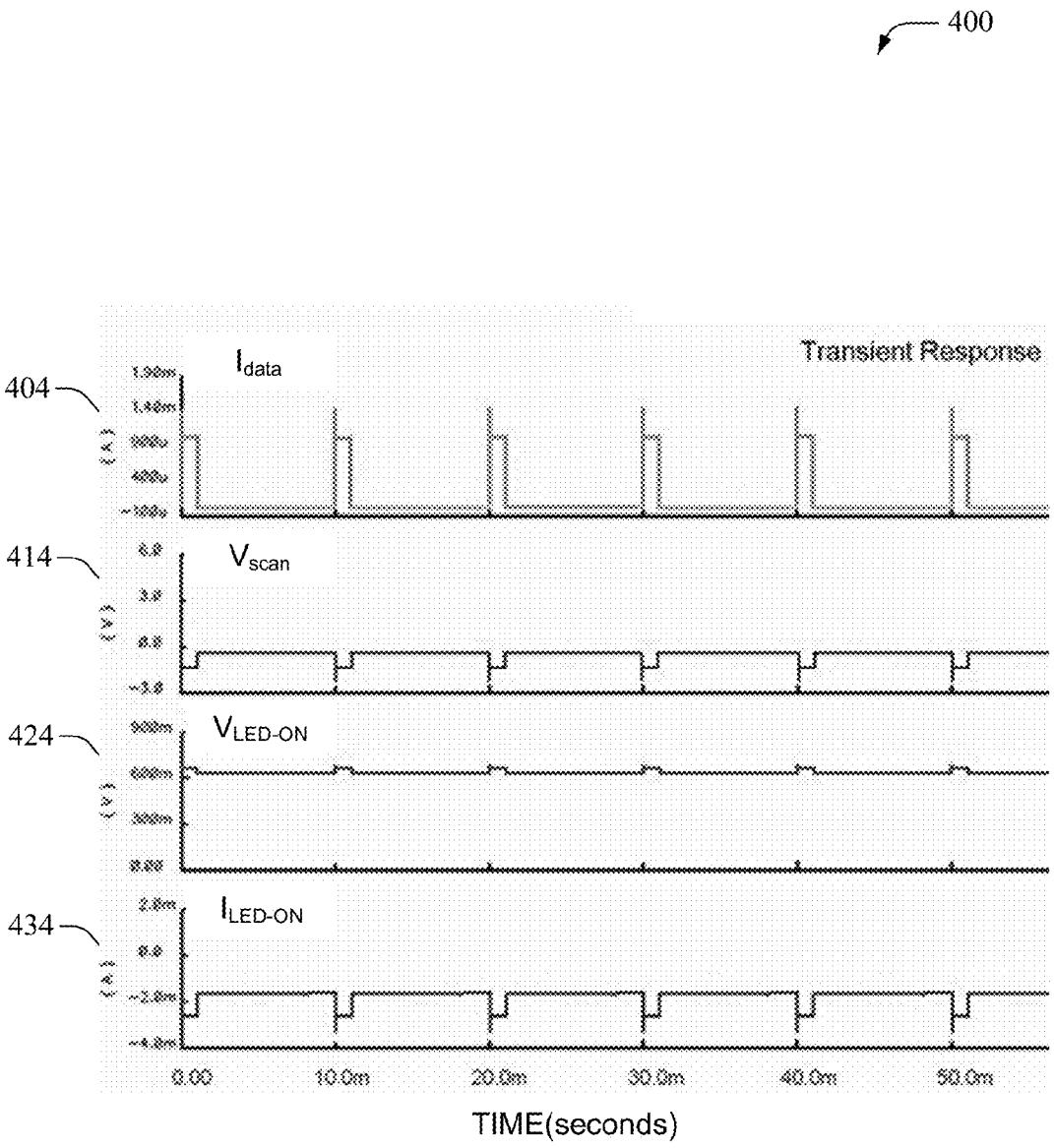
FIG. 4 is an example diagram of a transient response of a system that facilitates LEDoS prism based projection of an image, according to an aspect or embodiment of the subject disclosure.

FIG. 4 is an example non-limiting system 400 of a Cadence simulation of a driving circuit accordance with an exemplary embodiment of this disclosure. In an aspect, system 400 depicts a Cadence simulation of driving circuit 302 of FIG. 3.

As depicted, $I_{data}$ 404 represents a value of $I_{data}$ 334. $V_{scan}$ 414 represents a value of $V_{scan}$ 338. $V_{LED-ON}$ 424 represents a voltage when LED pixels 322 are in an on state. While, $I_{LED-ON}$ 434 represents a current value when LED pixels 322 are in an on state.

Figure 5:
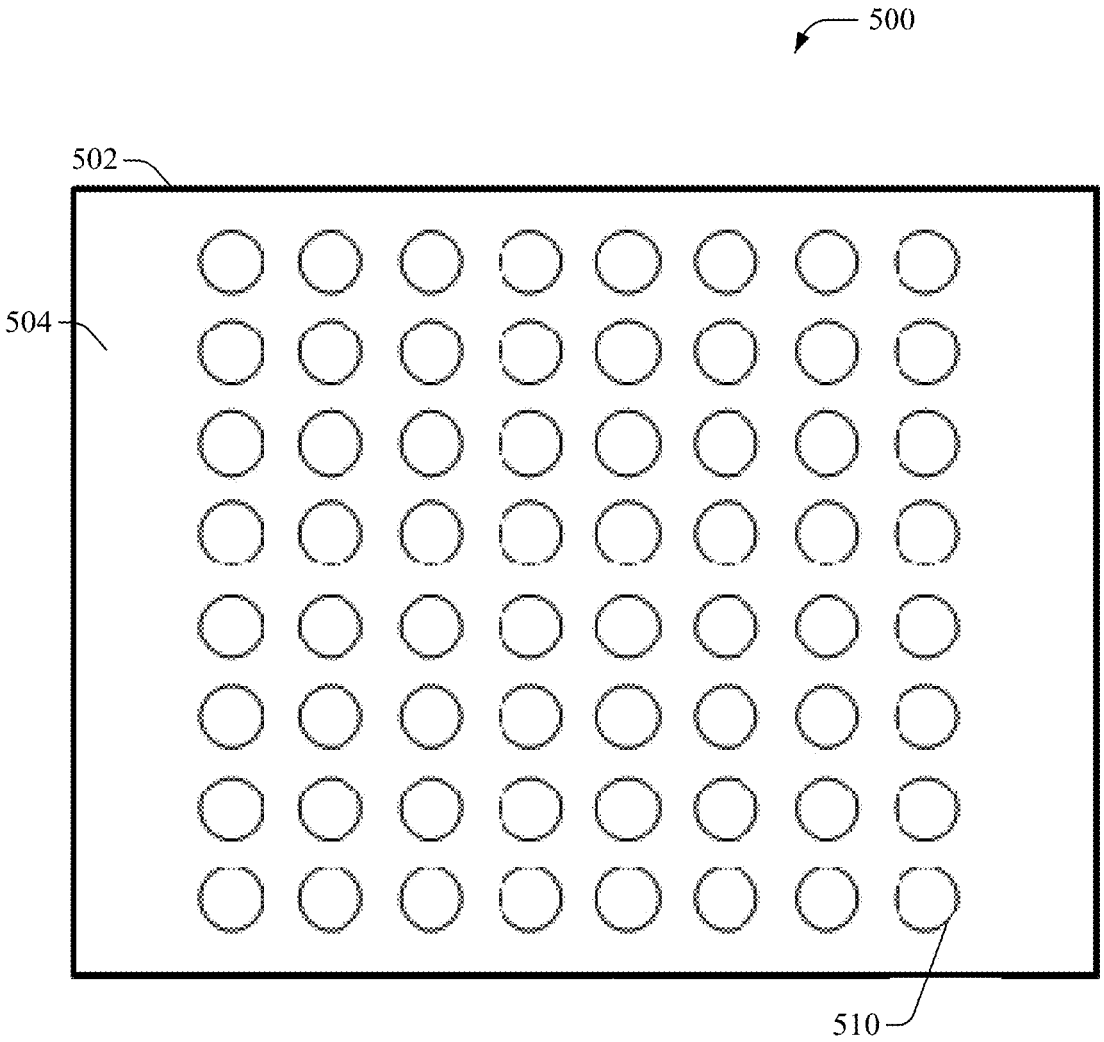
FIG. 5 is an example functional high level block diagram of a system that facilitates LEDoS prism based projection of an image including a number of LED pixels, according to an aspect or embodiment of the subject disclosure.

FIG. 5 is an example functional diagram of a system 500 that facilitates image projection utilizing an LEDoS system. It is noted that the system 500 depicts a top view of an LED micro display panel 502 (e.g., of LEDoS 130). LED micro display panel 502 can primarily comprise a substrate 504 connected to a plurality of pixels 510. While LED micro display panel 502 is depicted as comprising an eight by eight array of pixels, it is noted that LED micro display panel 502 can comprise various numbers of pixels in various arraignments.

In some embodiments, LED micro display panel 502 can be a monochromatic LED display panel that comprises pixels 510 of one color on a substrate 504. In other embodiments, LED micro display panel 502 can comprise a multiple color LED display panel that comprises pixels 510 of a plurality of colors on substrate 504.

Substrate 504 can provide fabrication materials and mechanical support for pixels 510. It is noted that substrate 504 can comprise sapphire, GaN, silicon carbide (SiC), quartz, silicon (Si), gallium arsenide (GaAs), indium phosphide (InP) or any other sufficiently materials for light emitting device growth. In another aspect, substrate 504 can be of a uniform construction, varied construction, solitary construction, removably attachable construction, and the like. Further, substrate 504 can comprise a transparent, semi-transparent or non-transparent substrate.

In an aspect, pixels 510 can comprise LED pixels that emit light when excited. In another aspect, pixels 510 can emit light within a defined wavelength. For example, pixels 510 emit light at wavelengths between 350 nanometer (nm), e.g., ultraviolent light, to 1,000 nm, e.g., infrared light). For example, emission wavelengths of or about 440 nm can correspond to blue pixels, emission wavelengths of or about 550 nm can correspond to green pixels, emission wavelengths of or about 610 nm can correspond to red pixels, and emission wavelengths of or about 380 can correspond to ultraviolent pixels.

In embodiments, pixels 510 can be configured to generate images at a defined resolution. As an example, pixels 510 can be configured for an 8×8 resolution for displaying images at an 800×480 resolution. It is noted that images generate by pixels 510 can be projected by a projection component such as optical projection component 120 of FIG. 1.

While pixels 510 are depicted as round and/or substantially round, it is noted that a shape of pixels 510 can be any number of shapes, such as circular shape, square shape, rectangle shape and hexagon shape. It is further noted that pixels 510, while depicted as having a uniform shape, can comprise pixels of various shapes.

Pixels 510 can have various dimensions based on a desired application and/or construction. In an aspect, pixels 510 can be within a defined range of dimensions based on a size criterion associated with LED micro display panel 502. As an example, each pixel of pixels 510 can have a diameter of 100 micrometers (μm) in circular shape construction, 300 μm×300 μm in square shape construction, and 300 μm×100 μm in rectangle shape construction.

In another aspect, LED micro display panel 502 can comprise color conversions materials on a back side (not shown) of the LED micro display panel 502. In an aspect, color conversion materials can be associated with a particular color. In an aspect, color conversion materials can be excited by ultraviolent light emitted from pixels 510 and can emit light of various colors (e.g., red, green, blue, white, yellow, etc.). In an aspect, conversion materials cam include phosphors powders, quantum dots, conversion films and other materials which can emit light with a certain wavelength when it is excited by light with a certain wavelength.

In another embodiment, color conversion materials can be located on top of pixel 510. It is noted that the color conversion materials can be attached to pixels 510 and/or substrate 504 based on methods of spin coating, dispensing, deposition, plating, evaporating and/or pasting. In another aspect, the color conversion materials can have shapes corresponding to shapes of pixels 510 (e.g., substantially square, substantially circular and other shapes). It is further noted that the color conversion materials can comprise dimensions substantially similar to dimensions of pixels 510.

In embodiments, substrate 504 can be a patterned-Si substrates with stain relief. In another aspect, substrate 504 can be a crack-free GaN epi-layers and GaN-based LEDs with optimized interlayers and device structures. A flow modulation method can be utilized, combined with AlN/AlGaN superlattice interlayers, to compromise the strain and for dislocation density propagation. In fabrication, a silicon substrate can be removed by chemical wet etching and pixels 510 can be transferred onto a plated copper substrate with an aluminum mirror.

In another aspect, system 500 can comprise a programmable active matrix (AM) LED micro-array (μ-array) on Si (LEDoS) using flip-chip technology. System 500 can be fabricated using a monolithic design and silicon IC fabrication technology. In an aspect, system 500 can be self-emitting that require no backlight, color filters, and/or polarization optics. LED micro display panel 502 can be composed of an AM panel fabricated on Si using conventional CMOS processes, with the monolithic LED array flipped on top. It is noted that cathodes of the pixels 510 can be connected together, and the anodes can be connected individually to driver circuit outputs.

It is noted that LED micro display panel 502 can comprise a full color display panel. In an aspect, pixels 510 can be fabricated using GaN wafers with a predetermined emission wavelength, such as at or about 380 nm (near UV). In operation, LED micro display panel 502 can excited, with the emitted light, color conversion martial such as phosphors having a defined color (e.g., red, green and blue). In an example, color phosphors can be on the surface of the LED micro display panel 502.

In another aspect, integration of micro-optical elements directly onto micro-pixels/LEDs can be done by jet-printing of suitable polymers. For jet-printing of color-conversion materials, the particles can be spherical and/or semi-spherical in shape. It is noted that the shape of the particles can be other shapes as well. As an example, color conversion materials can comprise Cd/Se embedded quantum dots into polymer microspheres, quantum dots offer remarkably higher quantum efficiencies, and/or microspheres dispensed via the jet-print technique.

It is noted that, micro-lenses can be directly printed onto pixels 510 for beam shaping and/or collimation. In an aspect, material can be dispensed onto a printhead, and can subsequently be cured with heat or UV light exposure. The materials can comprise, for example, UV epoxies and silicones, with the target of obtaining lens dimensions that match the microdisplay pixels, spherical profile and can attain long-term stability. It is further noted that functionally graded phosphor coating and encapsulation for refractive index matching can be utilized to reduce a total internal reflection effect. In an aspect, phosphor powder can be sequentially coated to form a layered structure with refractive index gradient in the thickness direction. Additionally and/or alternatively, a shape of silicone encapsulation can vary for controllable light pattern and uniformity.

It is noted that system 500 can be fabricated using a fine-pitch flip-chip assembly and compact wire bonding for interconnection of components for the miniaturization or system 500. It is noted that chip level heat dissipation can be addressed by underfill materials with high thermal conductivity and implementation of redundant thermal bumps/vias/routes in order to eliminate the up-stream bottleneck in the thermal path. Since system 500 can be used as a high power device, the air gap between pixels 500 and a substrate 504 can be a thermal barrier. Underfill materials can comprise silica, silica-coated aluminum nitride (SCAN), and the like can be as described herein.

Figure 6:
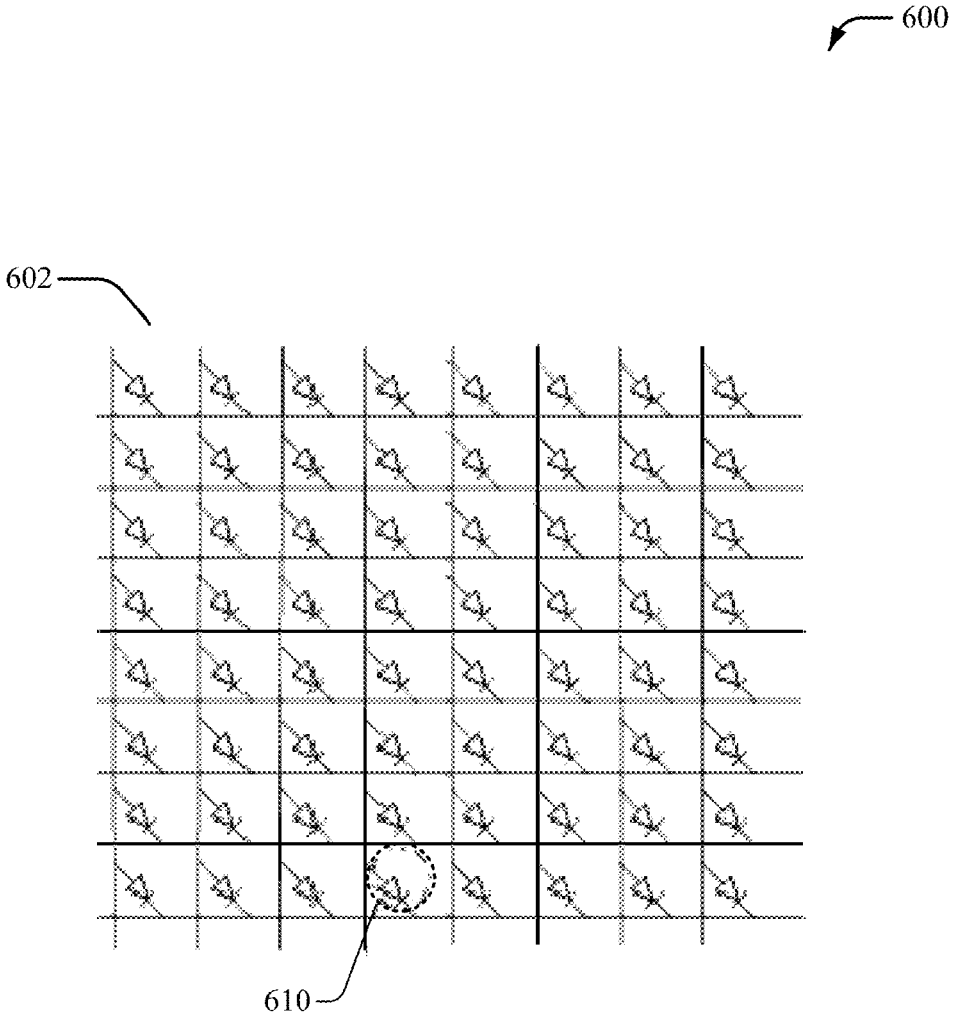
FIG. 6 is an example functional high level block diagram of a system that facilitates LEDoS prism based projection of an image including a passive matrix system, according to an aspect or embodiment of the subject disclosure.

FIG. 6 is an example functional diagram of a system 600 that facilitates image projection utilizing an LEDoS system. System 600 can comprise LED micro display panel 602 that comprises a plurality of pixels 610. While LED micro display panel 602 is depicted as comprising an eight by eight array of pixels, it is noted that LED micro display panel 602 can comprise various numbers of pixels in various arraignments.

LED micro display panel 602 can represent a passive matrix programmed monochromatic LED micro display panel. In an aspect, LED micro display panel 602 can represent LED micro display panel 502 and/or a micro display panel of LEDoS 130 of FIG. 1. It is noted that LED micro display panel 602 can, in response to execution of instructions, generate light and/or form images from generate light. It is further noted that generated light and/or images can be projected by a projection component (e.g., such as optical projection component 120 of FIG. 1). With reference to FIG. 5, LED micro display panel 602 can primarily comprise substrate 502 and pixels 510. In an aspect, pixels 510 can be substantially similar to pixels 610.

LED micro display panel 602, as shown, comprises a plurality of pixels 610. In an aspect, n-electrodes of pixels 610 can be connected in a row, column, and/or otherwise connected. Similarly, p-electrodes of pixels 610 can be connected in a row, column, and/or otherwise connected, wherein n represents negative and p represents positive. It is noted that n-electrodes of pixels 610 are referred to as connected in columns and p-electrodes of pixels 610 are referred to as connected in rows for brevity.

In an aspect, current can be applied between a determined row and a determined column. In response to applying the current, determined pixels of the pixels 610 can be excited. Exciting a pixel can cause the pixel to emit light. In an aspect, a controller can control which column and/or row receives current and which pixel of pixels 610 is excited.

Figure 7:
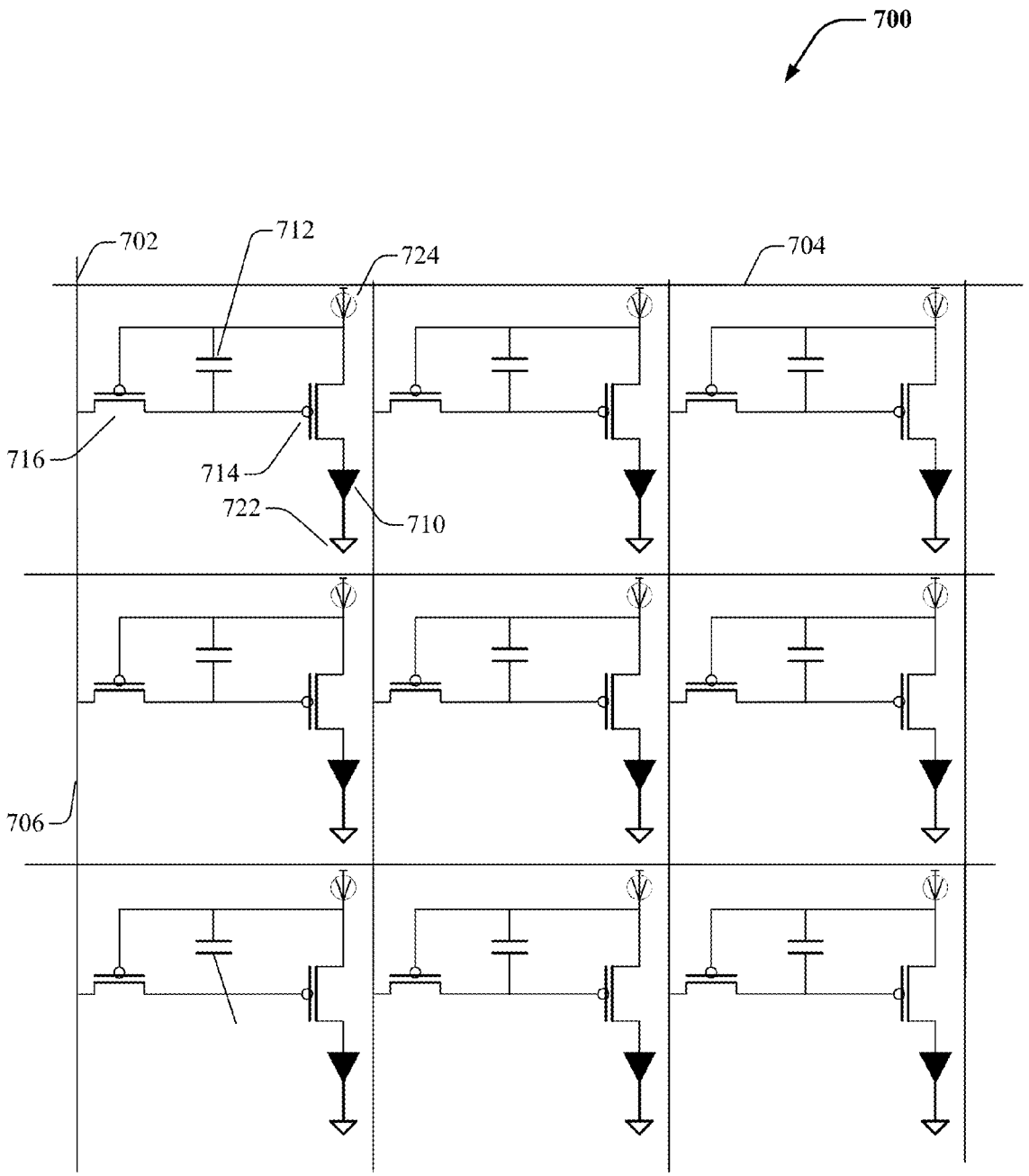
FIG. 7 is an example functional high level block diagram of a system that facilitates LEDoS prism based projection of an image including an active matrix system, according to an aspect or embodiment of the subject disclosure.

Referring now to FIG. 7, there illustrated is a schematic view 700 LED micro display panel 702 that comprises a plurality of pixels 710. It is noted that LED micro display panel 702 can comprise an active matrix programmed monochromatic LED micro-display panel. While LED micro display panel 702 is depicted as comprising a four by four array of pixels, it is noted that LED micro display panel 702 can comprise various numbers of pixels in various arraignments.

LED micro display panel 702 can represent a passive matrix programmed monochromatic LED micro display panel. In aspect, LED micro display panel 702 can represent LED micro display panel 502 and/or a micro display panel of LEDoS 130 of FIG. 1. It is noted that LED micro display panel 702 can, in response to execution of instructions, generate light and/or form images from generate light. It is further noted that generated light and/or images can be projected by a projection component (e.g., such as optical projection component 120 of FIG. 1). With reference to FIG. 5, LED micro display panel 702 can primarily comprise substrate 502 and pixels 510. In an aspect, pixels 510 can be substantially similar to pixels 710.

In another aspect, each pixel 710 can be controlled via electronic components primarily comprising scan line 706, data line 704, scan transistor 716, driving transistor 714, storage capacitor 712 and power source 724. It is noted that various other components and/or configurations of components can be utilized to form system 700. It is further noted that the various components can be utilized by one or more pixels. For example, while shown as individual power sources, power source 724 can control one or more pixels of the pixels 710.

In embodiments, n-electrodes of all or some of pixels 710 can be connected in a row, column, or otherwise connect. The n-electrodes can be connected together and to ground terminal 722. Similarly, p-electrodes of pixels 710 can be independently connect to an output terminal of driving transistors 714. It is noted that some or all of the p-electrodes of pixels 710 can be independently connected to driving transistors 714 and/or respectively connected to its own driving transistors.

Scan line 706 can receive scan signals. In response to receiving a defined scan signal, scan line 706 can turn a scan transistor 716 to an on state. Data line 704 can receive a data signal that can pass through scan transistor 716. In response to the data signal passing through scan transistor 716, driving transistor 714 can be switched to an on state. The data signal can further be stored in storage capacitor 712. In another aspect, driving transistor 714 can provide current, e.g., from power source 724, to pixel 710 and to ground terminal 722. In an aspect, pixel 710 can be excited in response to receiving current. In response to being excited, pixel 710 can be in an on state associated with emitting light.

In another aspect, storage capacitor 712 store a voltage to keep driving transistor 714 in an on state when the scan signal and data signal are removed. In an aspect, as driving transistor 714 is in an on state, current can flow power source 724 to pixel 710. In an aspect, pixel 710 can remain excited, for example during a whole display frame.

Figure 8:
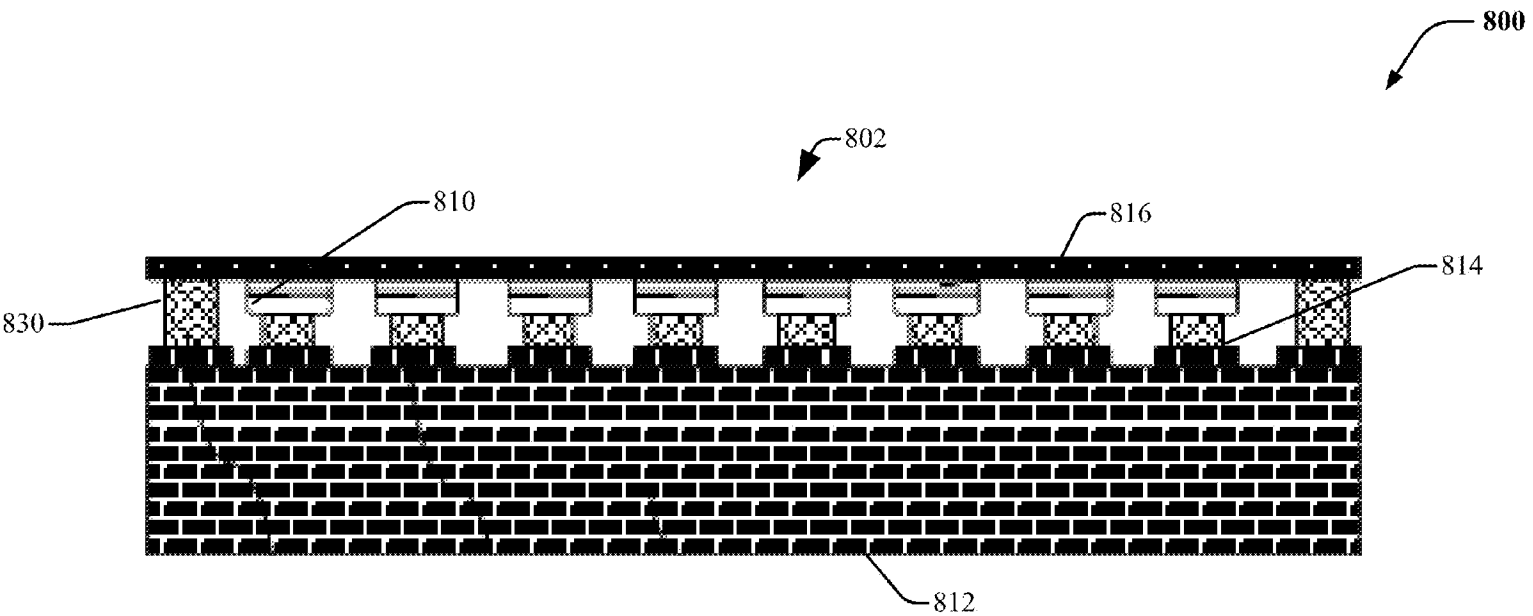
FIG. 8 is an example functional high level block diagram of a system that facilitates LEDoS prism based projection of an image including a cross sectional view of a display panel, according to an aspect or embodiment of the subject disclosure.

FIG. 8 is an example functional diagram of a system 800 that facilitates image projection utilizing an LEDoS system. It is noted that the system 800 depicts a cross sectional view of an LED micro display panel 802 (e.g., of LEDoS 130). In an aspect, LED micro display panel 802 can comprise a passive matrix programmed monochromatic LED display panel. In another aspect, the cross sectional view of LED micro display panel 802 can comprise a row and/or column of pixels 810. While pixels 810 are illustrated as aligning in a line, it is noted that pixels 810 can be in various formations. It is further noted that each pixel of pixels 810 can be identically formed and/or of various forms.

In embodiments, substrate 812 provides an electrical connection of a certain number of pixels 810. A corresponding number of solder bumps 830 and electrical pads 814 can be constructed on substrate 812. The corresponding number of solder bumps 830 and electrical pads 814 can be identical and/or substantially identical for each pixel 810.

With reference to FIG. 5, pixels 810 can comprise the n-electrodes of pixels 510 in a row. The n-electrodes of pixels 810 can connect to solder bumps 830 on substrate 812 at a left and a right side of the LED micro display panel 802. Further, individual p-electrodes of pixels 810 can connect to the solder bumps 830 in a middle. The n-electrodes of pixels 810 in the illustrated row can be connected together. The p-electrodes of pixels 810 in this row can be connected individually to solder bumps 830 and contact pads 814 provided on substrate 812.

It is noted that the shape and/or dimensions of pixels 810 can vary depending on desired configurations. In an aspect, pixels 810 can be of a substantially circular shape, substantially square shape, substantially rectangle shape, substantially hexagon shape, and/or of various other shapes. The dimension of pixels 810 can be sufficiently small to keep the size of LED micro display panel 802 within a range capable of being integrated in a frame.

In another aspect, substrate 812 may be made of Sapphire, GaN, SiC, Quartz, Silicon, GaAs, InP, PCB, and the like. Solder bumps 830 can be made of indium (In), lead (Pb), tin (Sn), gold (Au), silver (Ag), an alloy, and the like. Contact pads 814 can be made of Aluminum (Al), titanium (Ti), Au, platinum (Pt), nickel (Ni), Ag or any other sufficient conducting and low resistance materials such as highly doped Si, indium tin oxide (ITO), Zinc oxide (ZnO), stack layers of the above mentioned conductive and low resistance materials, and the like. It is noted that solder bumps 830 can have a determined diameter/bump pitch at a suitable range for system 800, such as 15/30 μm.

Figure 9:
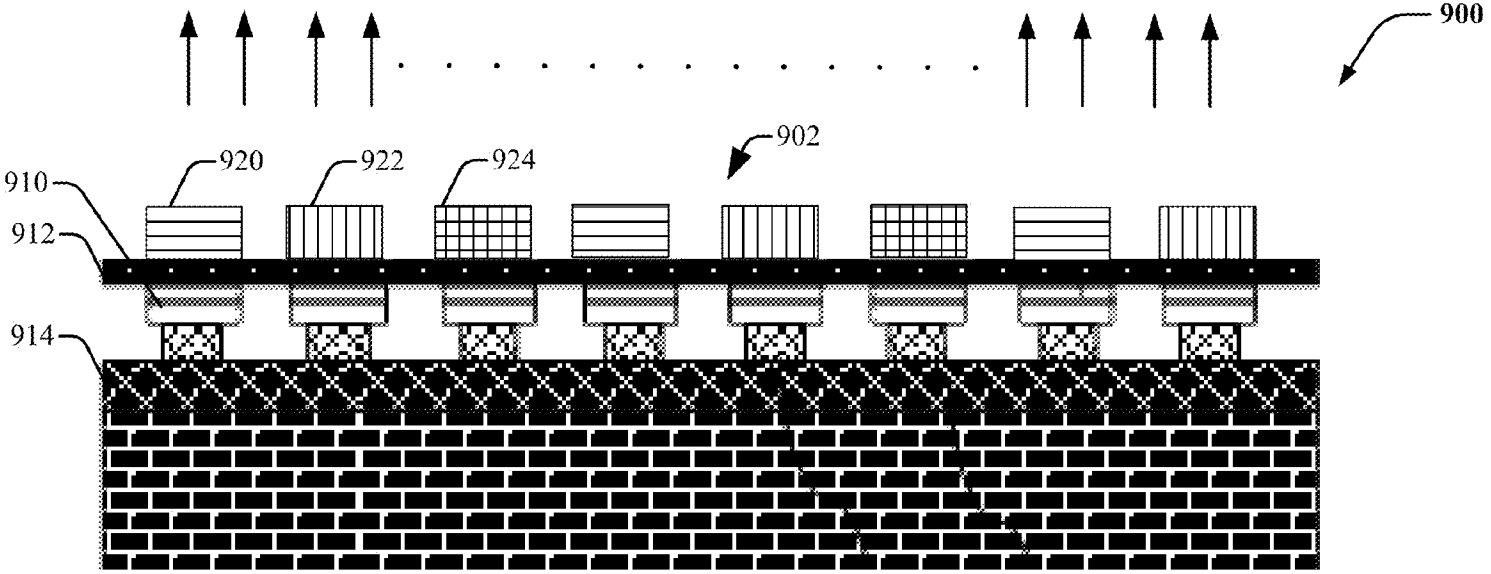
FIG. 9 is an example functional high level block diagram of a system that facilitates LEDoS prism based projection of an image including color conversion material, according to an aspect or embodiment of the subject disclosure.

FIG. 9 is an example functional diagram of a system 900 that facilitates image projection utilizing an LEDoS system including phosphors pounders. It is noted that the system 900 depicts a cross sectional view of an LED micro display panel 902 (e.g., of LEDoS 130). In an aspect, LED micro display panel 902 can comprise a multi color programmed monochromatic LED display panel. In another aspect, the cross sectional view of LED micro display panel 902 can comprise a row and/or column of pixels 910. While pixels 910 are illustrated as aligning in a line, it is noted that pixels 910 can be in various formations. It is further noted that each pixel of 910 can be identically formed and/or of various forms.

In embodiments, LED micro display panel 902 can comprise color conversion material having color conversion materials 920, 922 and 924 located on a first side of transparent substrate 912. Pixels 910 can be located between transparent substrate 912 and silicon substrate 914. A current can be applied to LED micro display panel 902 to selectively turn pixels 910 on and/or off.

In an aspect, each pixel of pixels 910 can have a determined emission wavelength to excite correlated color conversion materials 920, 922 and 924. For example, a pixel of pixels 910 can have an emission wavelength of or about 480 nm (ultra-violent) and the color conversion materials 920, 922 and 924 can be excited by this wavelength and emit light of a defined color (e.g., red color, green color blue color, etc.). As depicted pixels 910 can be associated with a particular color conversion materials 920, 922 and 924 of a determined color, wherein each of the color conversion materials 920, 922 and 924 has a shading to illustrate a different color. It is noted that color conversion materials 920, 922 and 924 can be made of phosphors, quantum dots, conversion films and other materials for color conversion. The color conversion materials 920, 922 and 924 may be deposited on first side of transparent substrate 912 by various methods, such as spin coating, dispensing, and/or pasting, for example. The color conversion materials 920, 922 and 924 can have a determined thickness within a range to meet requirements of a determined color quality. For example, a thickness of color conversion materials 920, 922 and 924 can be 10 μm. 7. It is noted that the surface of the LED display on the substrate can comprises cavities configured to receive the color conversion material.

Figure 10:
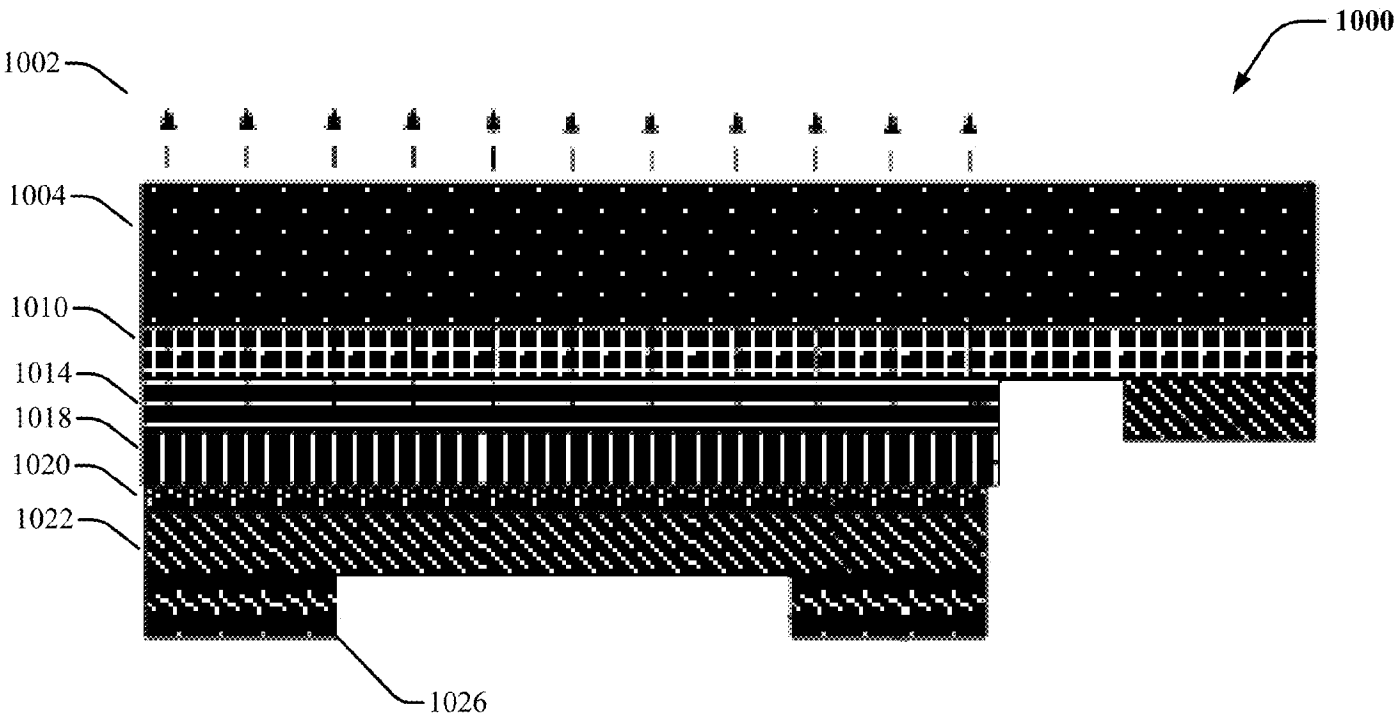
FIG. 10 is an example functional high level block diagram of a system that facilitates LEDoS prism based projection of an image including an LED pixel, according to an aspect or embodiment of the subject disclosure.

FIG. 10 is an example functional diagram of a system 1000 that facilitates image projection utilizing an LEDoS system. It is noted that the system 1000 depicts a schematic view of a pixel 1002. In an aspect, pixel 1002 can be utilized by active matrix programmed and passive matrix programmed LED micro-display panels, as described herein. Pixel 1002 can, in response to being excited by current, emit light 1002. In another aspect, pixel 1002 can primarily comprise a substrate 1004, n-GaN layer 1010, multiple-quantum well (MQW) 1014, p-GaN layer 1018, current spreading layer 920, p and n electrode 1022 and passivation layer 1026.

Substrate 904 may be made of sapphire, GaN, SiC, Quartz, Silicon, GaAs, InP. MQW can be 5 periods. Current spreading layer 1020 may be made of Ni, Au, Ag, ITO, ZnO, AgO and stack layers of above materials. The p and n electrode 1022 may be made of Al, Ti, Au, Pt, Ni, Ag or any other sufficient conduct and low resistance materials.

In embodiments, pixel 1002 can be comprised on a an electronic circuit, such as LEDoS micro display panel 502, 602, 702, 802, and/or 902 of FIGS. 5-9 respectively. The circuit can provide a current that excites the layers of pixel 1002. In response to receiving the current, pixel 1002 can emit light at various wave lengths and be in a state defined as an on state. In another aspect, when pixel 1002 does not receive current, pixel 1002 will not emit light in a state defined as an off state. It is noted that LEDoS components (e.g., LEDoS component 130 of FIG. 1) can control pixel 1002 to selectively switch pixel 1002 to an on and/or off state. In embodiments, a set of pixels can be controlled to generate an image.

Figure 11:
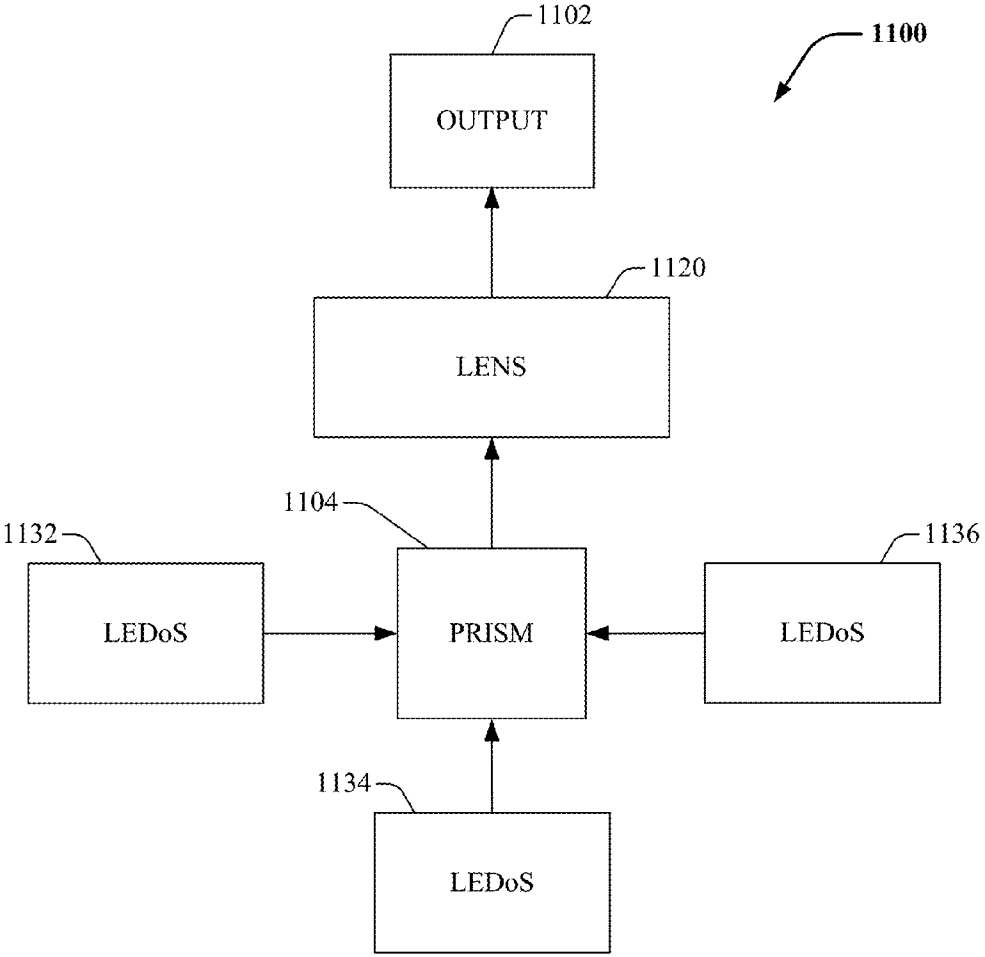
FIG. 11 is an example functional high level block diagram of a system that facilitates LEDoS prism based projection of an image including multiple LEDoS display panels, according to an aspect or embodiment of the subject disclosure.

FIG. 11 is an example functional block diagram of a system 1100 that facilitates multicolor image projection utilizing an LEDoS system. While the various components are illustrated as separate components, it is noted that the various components can be comprised in one or more other components. Further, it is noted that the system 1100 can comprise additional components not shown for readability. Additionally, various aspects described herein may be performed by one device or on a number of devices in communication with each other. It is further noted that system 1100 can be within larger systems. In implementations, system 1100 can comprise an LEDoS components 1132, 1134 and 1136 that can generate an image, a prism component 1104 that can focus and/or culminate light to form an image, and a lens 1120 that can project and/or display the image. In an aspect, system 1100 can further comprise a memory component and processing component that can comprise a computer processor or the like. In an aspect, the memory component can store computer executable components and/or instructions for components and the processing component can execute the computer executable components and/or facilitate implementation of the components.

In an aspect, each LEDoS component 1132, 1134 and 1136 can comprise an LEDoS associated with one or more determined colors such as red, green and blue for RGB output, and the like. In an aspect, LEDoS components 1132, 1134 and 1136 can comprise an LEDoS chip and/or packaging boards. In another aspect, LEDoS components 1132, 1134 and 1136 can be attached (removably and/or non-removably) to each other. For example, each LEDoS component 1132, 1134 and 1136 can be die-attached and wire-bonded onto individual packaging boards and then connected to a control board. The packaging boards can be mounted onto a prism 1104, such as a tri-color prism. In an aspect, an image can be formed by prism 1104 in response to receiving color components from one or more of the LEDoS component 1132, 1134 and 1136. It is noted that the image can be a full-color image. While FIG. 11, illustrates three LEDoS components, it is noted that system 1100 can comprise various numbers of LEDoS components associated with various colors.

In embodiments, a processor can transmit instructions to each of the LEDoS component 1132, 1134 and 1136 that comprises instructions to activate pixels to form an image. A signal boards can supply power and control to tune the brightness level of the respective LEDoS components 1132, 1134 and 1136. Fine adjustment of the three micro-display positions can be performed using mounting screws for alignment of the images.

Lens 1120 can receive an image from prism 1104 and can project the image. In an aspect, lens 120 can magnify and/or focus the image. For example, lens 1120 can receive an image and project the image onto a surface. Lens 1120 can be adjusted (e.g., moved with respect to prism 1104) to focus the image. In another aspect, lens 1120 can comprise one or more lenses consisting of a transparent and/or semi-transparent composition. It is noted that lens 1120 can comprise mirrors, optical lenses, and the like.

Figure 12:
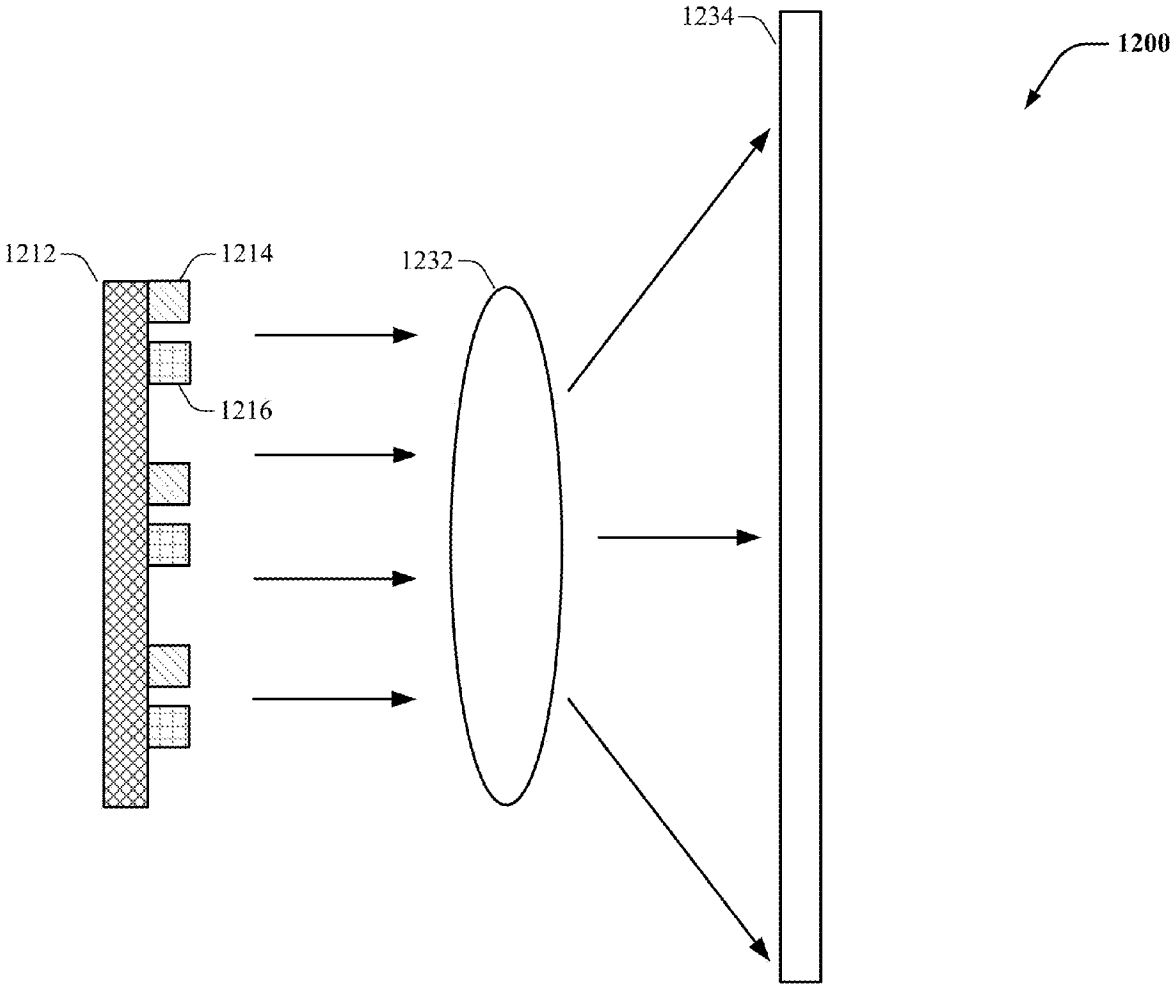
FIG. 12 is an example functional high level block diagram of a system that facilitates LEDoS prism based projection of an image including an ultraviolet full color LEDoS display panels, according to an aspect or embodiment of the subject disclosure.

FIG. 12 is an example functional block diagram of a system 1200 that facilitates multicolor image projection utilizing an LEDoS system. While the various components are illustrated as separate components, it is noted that the various components can be comprised in one or more other components. Further, it is noted that the system 1200 can comprise additional components not shown for readability. Additionally, various aspects described herein may be performed by one device or on a number of devices in communication with each other. It is further noted that system 1200 can be within larger systems. In implementations, system 1200 can comprise an LEDoS chip 1212 which can emit light at a first wavelength (e.g., a first color) and can comprise color conversion material 1214 and color conversion material 1216 (which can convert the light). System 1200 can also include a lens 1232 that can receive light and project the light onto a projection surface 1234, for example. In an aspect, system 1200 can further comprise a memory component and processing component that can comprise a computer processor or the like. In an aspect, the memory component can store computer executable components and/or instructions for components and the processing component can execute the computer executable components and/or facilitate implementation of the components.

In an aspect, LEDoS chip 1212 can an LEDoS chip configured for generating a single color of light (e.g., monochromatic light). Color conversion material 1214 can comprise color conversion material that receives light and alters or converts the light to a second color (e.g., red). Color conversion material 1216 can comprise color conversion material that receives light and alters or converts the light to a third color (e.g., green). While system 1200 depicts two color conversions materials, it is noted that system 1200 can comprise various color conversion materials that can alter light to various colors. It is also note that various colors can be utilized depending on a desired configuration. In another aspect, various colors can be generated and blended to form various other colors.

In an aspect, projection surface 1234 can comprise various materials such as glass, plastic, cloth, etc. In one aspect, projection surface 1234 comprises an opaque and/or semi-opaque surface that can receive light at one side and display the light at a second side that is parallel or substantially parallel to the first side. It is further noted that projection surface 1234 can comprise a combination of materials.

Figure 13:
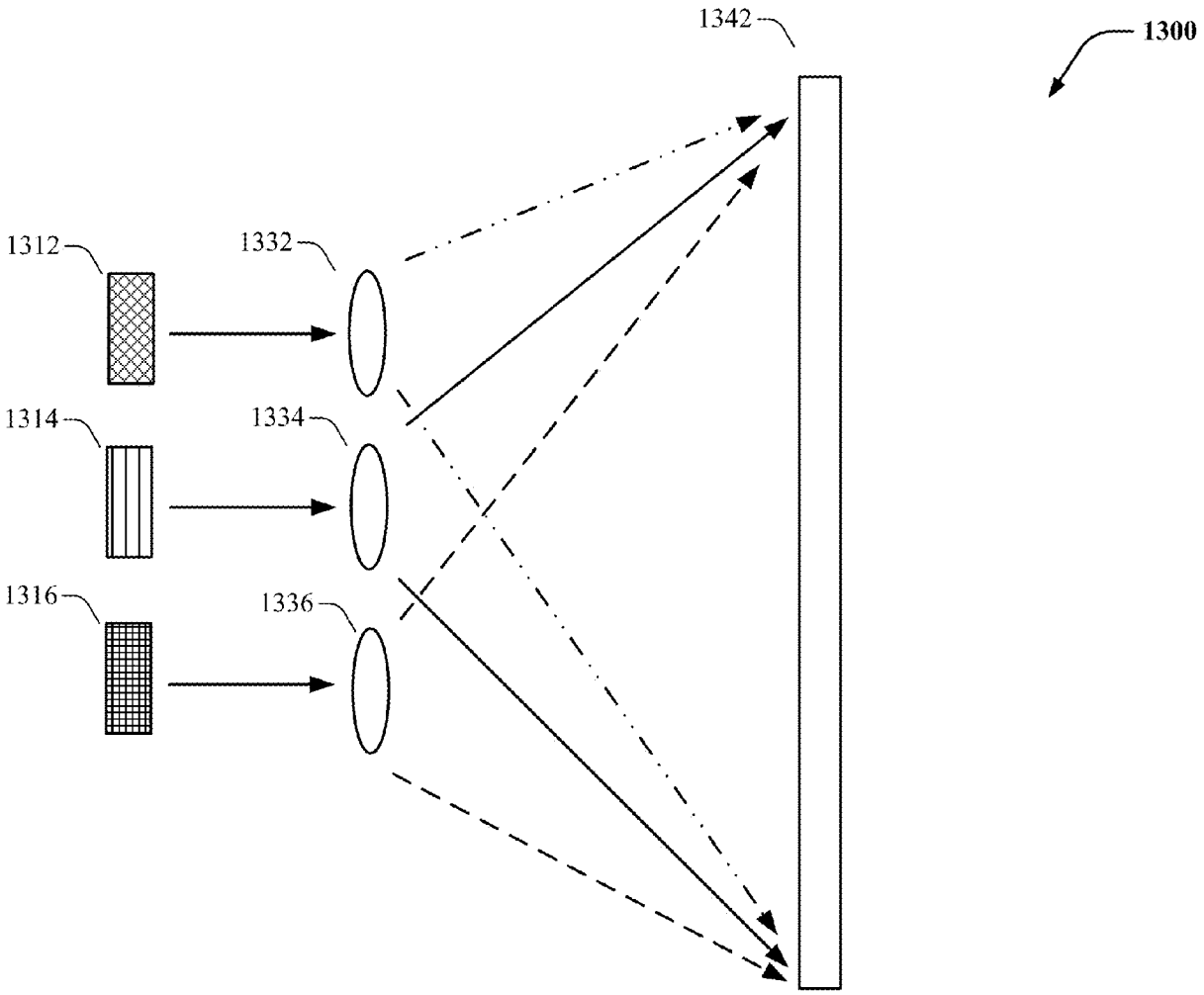
FIG. 13 is an example functional high level block diagram of a system that facilitates LEDoS based projection of an image including a multi lens multi chip display, according to an aspect or embodiment of the subject disclosure.

FIG. 13 is an example functional block diagram of a system 1300 that facilitates multicolor image projection utilizing an LEDoS system. While the various components are illustrated as separate components, it is noted that the various components can be comprised in one or more other components. Further, it is noted that the system 1300 can comprise additional components not shown for readability. Additionally, various aspects described herein may be performed by one device or on a number of devices in communication with each other. It is further noted that system 1300 can be within larger systems. In implementations, system 1300 can comprise LEDoS chips 1312, 1314 and 1316 which can emit light at a determined wavelength (e.g., various colors color). System 1300 can also include lenses 1332, 1334 and 1336 that can focus and/or culminated light emitted from LEDoS chips 1312, 1314 and 1316. In an aspect, a projection surface 1342 can receive light from lenses 1332, 1334 and 1336, for example.

It is noted that each LEDoS chips 1312, 1314 and 1316 is shaded differently to depict a respective associated color, such as red, green, blue, white, yellow, etc. While three LEDoS chips are illustrated, it is noted that system 1300 can comprise a different number of LEDoS chips. Likewise, while three lenses are shown it is noted that system 1300 can comprise a different number of lenses. It is further noted that system 1300 need not comprise a same number of lenses as LEDoS chips.

Figure 14:
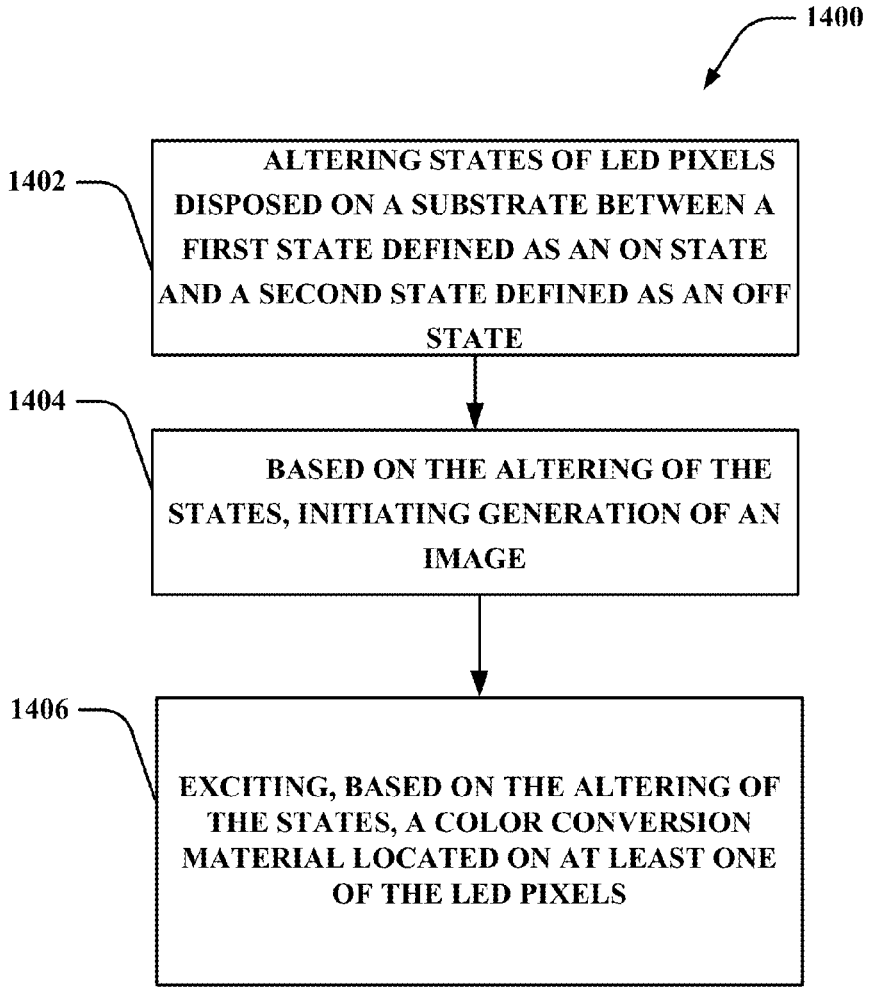
FIG. 14 is an example non-limiting process flow diagram of a method facilitates LEDoS prism based projection of an image, according to an aspect or embodiment of the subject disclosure.
Figure 15:
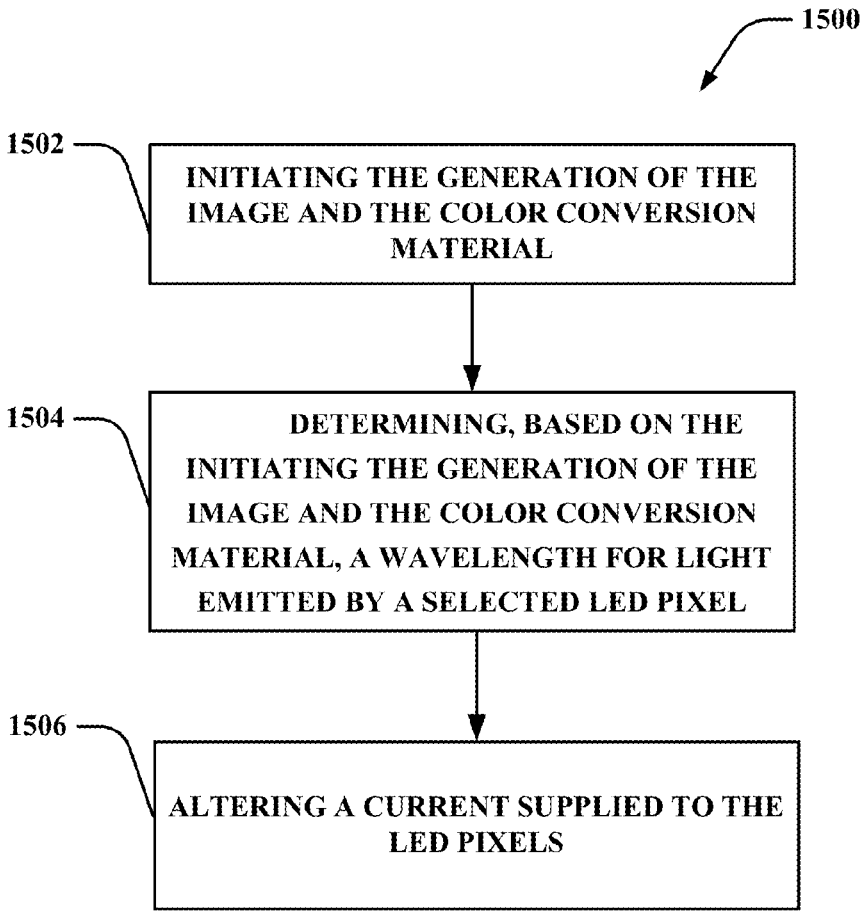
FIG. 15 is an example non-limiting process flow diagram of a method facilitates LEDoS prism based projection of an image including altering current supplied to LED pixels, according to an aspect or embodiment of the subject disclosure.

FIGS. 14-15 illustrate methods 1400 and 1500 that can facilitate image projection in an LEDoS system. For simplicity of explanation, the methods (or procedures) are depicted and described as a series of acts. It is noted that the various embodiments are not limited by the acts illustrated and/or by the order of acts. For example, acts can occur in various orders and/or concurrently, and with other acts not presented or described herein. In another aspect, the various acts can be performed by systems and/or components of embodiments described herein.

FIG. 14 illustrated is an example non-limiting process flow diagram of a method 1400 that facilitates image projection utilizing an LEDoS system. The image projection can be performed by various implementations described herein.

At 1402, a system can alter states of LED pixels disposed on a substrate between a first state defined as an on state and a second state defined as an off state. In an aspect, the on state can comprise a state wherein an LED pixel, in response to receiving current, emits light. In another aspect, the off state can comprise a state wherein an LED pixel, in response to not receiving current, does not emit light.

At 1404, a system can initiate generation, based on the altering of the states, of an image. For example, a system can selectively alter states of LED pixels to form an image. In an aspect, the image can be formed based on instructions associated with a stored image.

At 1406, a system can excite, based on the altering of the states, a color conversion material located on at least one of the LED pixels. In an aspect, color conversion material can comprise one or more layers of color conversion material. The color conversion material can be excited when light at a determined wavelength is applied.

FIG. 1500 illustrated is an example non-limiting process flow diagram of a method 1500 for image projection utilizing an LEDoS system including altering a current supplied to LED pixels.

At 1502, a system can initiate generation, based on the altering of the states, of an image. For example, a system can selectively alter states of LED pixels to form an image. In an aspect, the image can be formed based on instructions associated with a stored image.

At 1504, a system can determine, based on the initiating the generation of the image and the color conversion material, a wavelength for light emitted by a selected LED pixel. It is noted that color conversion materials can be excited at various wave lengths.

At 1506, a system can alter a current supplied to the LED pixels. In an aspect, a current can cause an LED pixel to emit light. Altering the current can alter the states of LED pixels. As states of LED pixels change, an output can change.

Figure 16:
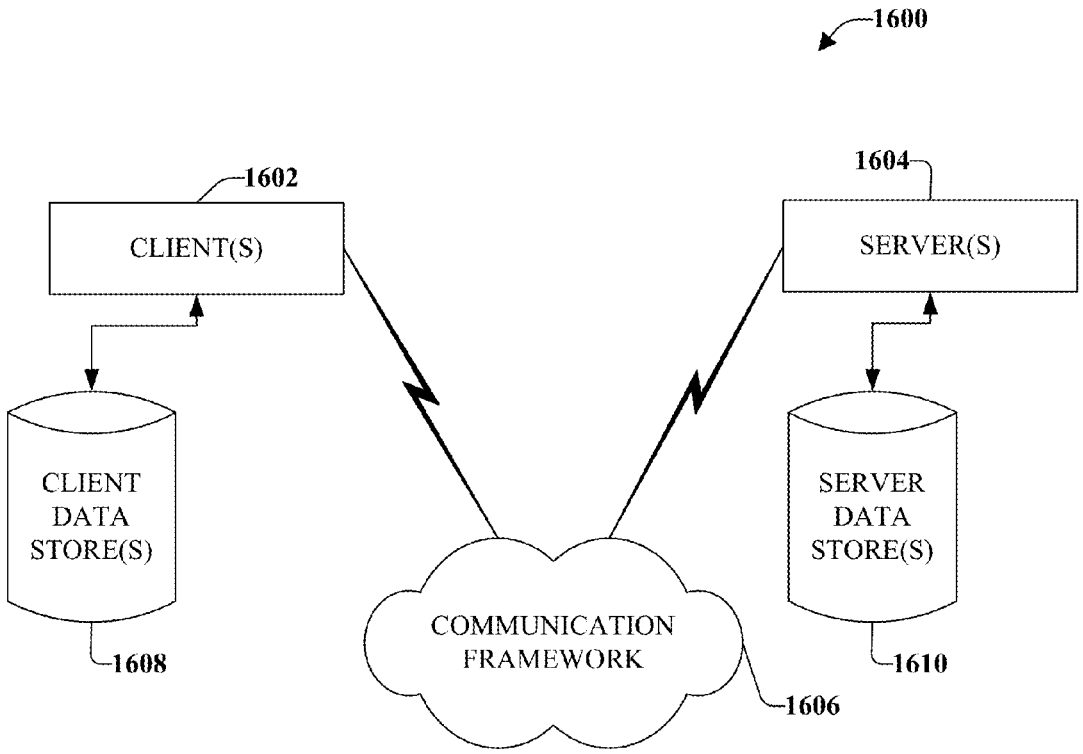
FIG. 16 illustrates an example schematic block diagram of a computing environment in accordance various aspects of this disclosure.

Referring now to FIG. 16, there is illustrated a schematic block diagram of a computing environment 1600 in accordance with this specification that can control operations of an LEDoS system in a networked computing environment. The system 1600 includes one or more client(s) 1602, (e.g., computers, smart phones, tablets, cameras, PDA's). The client(s) 1602 can be hardware and/or software (e.g., threads, processes, computing devices). The client(s) 1602 can house cookie(s) and/or associated contextual information by employing the specification, for example.

In an aspect, system 1600 can be utilized in networked environment to control an LEDoS projection system as describe herein. As an example, client 1602 can comprise an iTL system capable of networked communications. Continuing with the example, client 1602 can receive instructions to alter and/project an image.

The system 1600 also includes one or more server(s) 1604. The server(s) 1604 can also be hardware or hardware in combination with software (e.g., threads, processes, computing devices). The servers 1604 can house threads to perform transformations by employing aspects of this disclosure, for example. One possible communication between a client 1602 and a server 1604 can be in the form of a data packet adapted to be transmitted between two or more computer processes wherein data packets may include coded items. The data packet can include a cookie and/or associated contextual information, for example. The system 1600 includes a communication framework 1606 (e.g., a global communication network such as the Internet) that can be employed to facilitate communications between the client(s) 1602 and the server(s) 1604.

Communications can be facilitated via a wired (including optical fiber) and/or wireless technology. The client(s) 1602 are operatively connected to one or more client data store(s) 1608 that can be employed to store information local to the client(s) 1602 (e.g., cookie(s) and/or associated contextual information). Similarly, the server(s) 1604 are operatively connected to one or more server data store(s) 1610 that can be employed to store information local to the servers 1604.

In one implementation, a server 1604 can transfer an encoded file, (e.g., network selection policy, network condition information, etc.), to client 1602. Client 1602 can store the file, decode the file, or transmit the file to another client 1602. It is noted, that a server 1604 can also transfer uncompressed file to a client 1602 and client 1602 can compress the file in accordance with the disclosed subject matter. Likewise, server 1604 can encode information and transmit the information via communication framework 1606 to one or more clients 1602.

Figure 17:
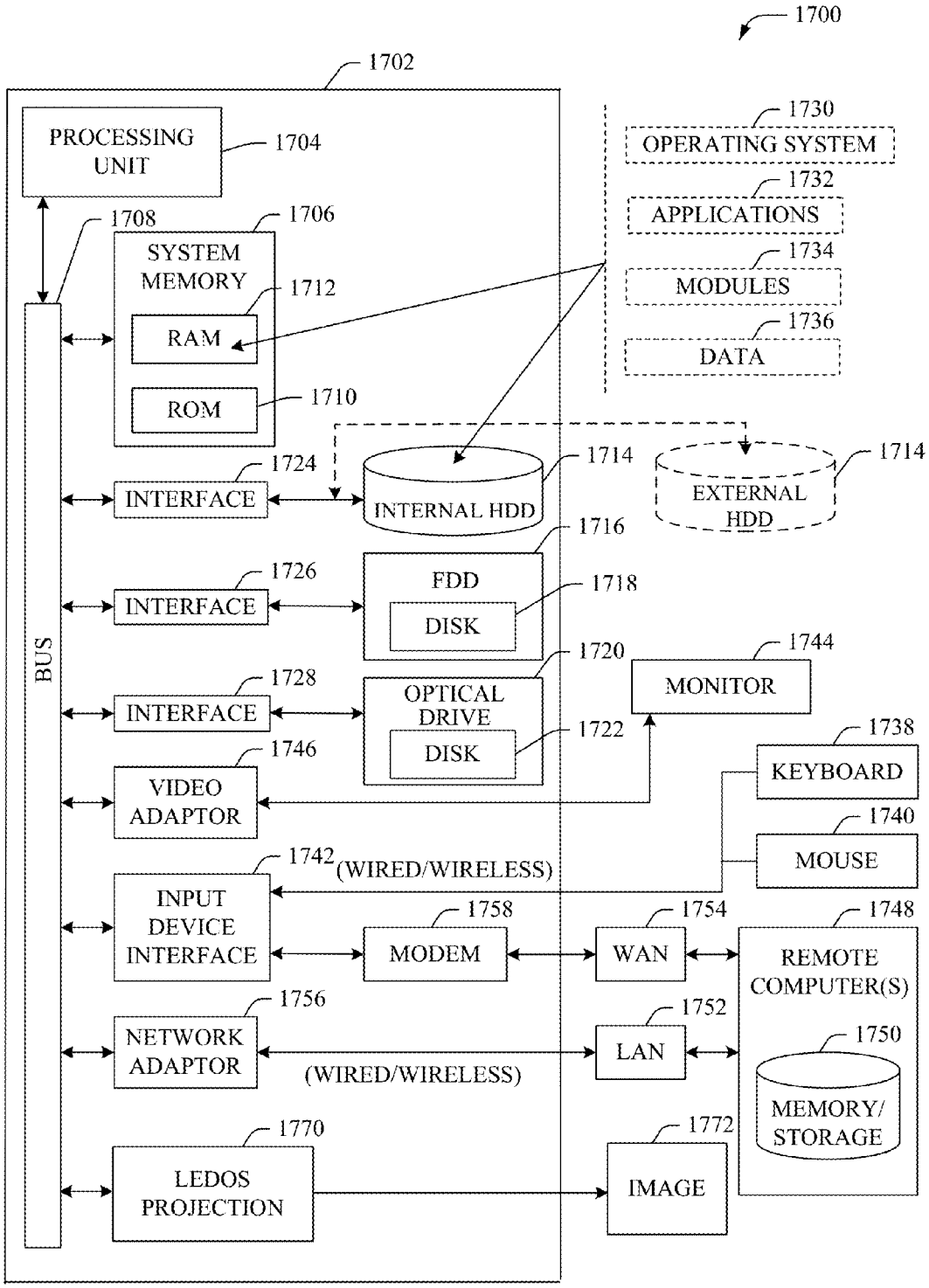
FIG. 17 illustrates a block diagram of a computer operable to execute the disclosed communication architecture.

Referring now to FIG. 17, there is illustrated a block diagram of a computer operable to execute the disclosed LEDoS projection systems. In order to provide additional context for various aspects of the subject specification, FIG. 17 and the following discussion are intended to provide a brief, general description of a suitable computing environment 1700 in which the various aspects of the specification can be implemented. While the specification has been described above in the general context of computer-executable instructions that can run on one or more computers, it is noted that the specification also can be implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the specification can also be practiced in distributed computing environments, including cloud-computing environments, where certain tasks are performed by remote processing devices that are linked through a communications network. In a distributed computing environment, program modules can be located in both local and remote memory storage devices.

Computing devices can include a variety of media, which can include computer-readable storage media and/or communications media, which two terms are used herein differently from one another as follows. Computer-readable storage media can be any available storage media that can be accessed by the computer and includes both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

Communications media typically include (and/or facilitate the transmission of) computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communications media include wired media, such as a wired network or direct-wired connection, and wireless media such as acoustic, RF, infrared and other wireless media.

With reference again to FIG. 17, the example environment 1700 for implementing various aspects of the specification includes a computer 1702, the computer 1702 including a processing unit 1704, a system memory 1706 and a system bus 1708. The system bus 1708 couples system components including, but not limited to, the system memory 1706 to the processing unit 1704. The processing unit 1704 can be any of various commercially available processors. Dual microprocessors and other multi-processor architectures can also be employed as the processing unit 1704.

The system bus 1708 can be any of several types of bus structure that can further interconnect to a memory bus (with or without a memory controller), a peripheral bus, and a local bus using any of a variety of commercially available bus architectures. The system memory 1706 includes read-only memory (ROM) 1710 and random access memory (RAM) 1712. A basic input/output system is stored in a non-volatile memory 1710 such as ROM, erasable programmable read only memory, electrically erasable programmable read only memory, which basic input/output system contains the basic routines that help to transfer information between elements within the computer 1702, such as during startup. The RAM 1712 can also include a high-speed RAM such as static RAM for caching data.

The computer 1702 further includes an internal hard disk drive 1714 (e.g., EIDE, SATA), which internal hard disk drive 1714 can also be configured for external use in a suitable chassis (not shown), a magnetic floppy disk drive 1716, (e.g., to read from or write to a removable diskette 1718) and an optical disk drive 1720, (e.g., reading a CD-ROM disk 1722 or, to read from or write to other high capacity optical media such as the DVD). The hard disk drive 1714, magnetic disk drive 1716 and optical disk drive 1720 can be connected to the system bus 1708 by a hard disk drive interface 1724, a magnetic disk drive interface 1726 and an optical drive interface 1728, respectively. The interface 1724 for external drive implementations includes at least one or both of Universal Serial Bus (USB) and IEEE 1594 interface technologies. Other external drive connection technologies are within contemplation of the subject specification.

The drives and their associated computer-readable storage media provide nonvolatile storage of data, data structures, computer-executable instructions, and so forth. For the computer 1702, the drives and storage media accommodate the storage of any data in a suitable digital format. Although the description of computer-readable storage media above refers to a HDD, a removable magnetic diskette, and a removable optical media such as a CD or DVD, it should be noted by those skilled in the art that other types of storage media which are readable by a computer, such as zip drives, magnetic cassettes, flash memory cards, cartridges, and the like, can also be used in the example operating environment, and further, that any such storage media can contain computer-executable instructions for performing the methods of the specification.

A number of program modules can be stored in the drives and RAM 1712, including an operating system 1730, one or more application programs 1732 (e.g., an image projection program), other program modules 1734 and program data 1736. All or portions of the operating system, applications, modules, and/or data can also be cached in the RAM 1712. It is noted that the specification can be implemented with various commercially available operating systems or combinations of operating systems.

A user can enter commands and information into the computer 1702 through one or more wired/wireless input devices, e.g., a keyboard 1738 and a pointing device, such as a mouse 1740. Other input devices (not shown) can include a microphone, an IR remote control, a joystick, a game pad, a stylus pen, touch screen, or the like. These and other input devices are often connected to the processing unit 1704 through an input device interface 1742 that is coupled to the system bus 1708, but can be connected by other interfaces, such as a parallel port, an IEEE 1594 serial port, a game port, a USB port, an IR interface, etc.

A monitor 1744 or other type of display device is also connected to the system bus 1708 via an interface, such as a video adapter 1746. In addition to the monitor 1744, a computer typically includes other peripheral output devices (not shown), such as speakers, printers, etc.

An LEDoS projection system 1770 can be connected to the system bus 1708 via an interface. In an aspect, LEDoS projection system 1770 can comprise various systems presented herein. In response to receiving instructions, such as from processor 1704, LEDoS projection system 1770 can generate an image 1772. It is noted that LEDoS projection system can project image 1772 onto a display such as a display of monitor 1744 and/or an external display.

The computer 1702 can operate in a networked environment using logical connections via wired and/or wireless communications to one or more remote computers, such as a remote computer(s) 1748. The remote computer(s) 1748 can be a workstation, a server computer, a router, a personal computer, portable computer, microprocessor-based entertainment appliance, a peer device or other common network node, and typically includes many or all of the elements described relative to the computer 1702, although, for purposes of brevity, only a memory/storage device 1750 is illustrated. The logical connections depicted include wired/wireless connectivity to a local area network 1752 and/or larger networks, e.g., a wide area network 1754. Such local area network and wide area network networking environments are commonplace in offices and companies, and facilitate enterprise-wide computer networks, such as intranets, all of which can connect to a global communications network, e.g., the Internet.

When used in a local area network networking environment, the computer 1702 is connected to the local network 1752 through a wired and/or wireless communication network interface or adapter 1756. The adapter 1756 can facilitate wired or wireless communication to the local area network 1752, which can also include a wireless access point disposed thereon for communicating with the wireless adapter 1756.

When used in a wide area network environment, the computer 1702 can include a modem 1758, or is connected to a communications server on the wide area network 1754, or has other means for establishing communications over the wide area network 1154, such as by way of the Internet. The modem 1758, which can be internal or external and a wired or wireless device, is connected to the system bus 1708 via the serial port interface 1742. In a networked environment, program modules depicted relative to the computer 1702, or portions thereof, can be stored in the remote memory/storage device 1750. It is noted that the network connections shown are example and other means of establishing a communications link between the computers can be used.

The computer 1702 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. In an example embodiment, wireless communications can be facilitated, for example, using Wi-Fi, Bluetooth™, Zigbee, and other 802.XX wireless technologies. Thus, the communication can be a predefined structure as with a conventional network or simply an ad hoc communication between at least two devices.

Wi-Fi, or Wireless Fidelity, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11 (a, b, g, n, etc.) to provide secure, reliable, fast wireless connectivity. A Wi-Fi network can be used to connect computers to each other, to the Internet, and to wired networks (which use IEEE 802.3 or Ethernet). Wi-Fi networks can operate in the unlicensed 2.4 and 5 GHz radio bands, at an 11 Mbps (802.11a), 54 Mbps (802.11b), or 170 Mbps (802.11n) data rate, for example, or with products that contain both bands (dual band), so the networks can provide real-world performance similar to wired Ethernet networks used in many homes and/or offices.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nanoscale architectures such as, but not limited to, molecular and quantum-dot based transistors, switches and gates, in order to optimize space usage or enhance performance of user equipment. A processor may also be implemented as a combination of computing processing units.

In the subject specification, terms such as "data store," "data storage," "database," and substantially any other information storage component relevant to operation and functionality of a component, refer to "memory components," or entities embodied in a "memory" or components comprising the memory. It is noted that the memory components, or computer-readable storage media, described herein can be either volatile memory(s) or nonvolatile memory(s), or can include both volatile and nonvolatile memory(s).

By way of illustration, and not limitation, nonvolatile memory(s) can include read only memory (ROM), programmable ROM (PROM), electrically programmable ROM (EPROM), electrically erasable ROM (EEPROM), or flash memory. Volatile memory(s) can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

As used in this application, the terms "component," "module," "system," "interface," "platform," "service," "framework," "connector," "controller," or the like are generally intended to refer to a computer-related entity, either hardware, a combination of hardware and software, software, or software in execution or an entity related to an operational machine with one or more specific functionalities. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. As another example, an interface can include I/O components as well as associated processor, application, and/or API components.

Further, the various embodiments can be implemented as a method, apparatus, or article of manufacture using standard programming and/or engineering techniques to produce software, firmware, hardware, or any combination thereof to control a computer to implement one or more aspects of the disclosed subject matter. An article of manufacture can encompass a computer program accessible from any computer-readable device or computer-readable storage/communications media. For example, computer readable storage media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). Of course, those skilled in the art will recognize many modifications can be made to this configuration without departing from the scope or spirit of the various embodiments.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A device, comprising:

an active matrix light-emitting diode (LED) display on a substrate comprising LED pixels located on a surface of the substrate, wherein the LED pixels emit light resulting in emitted light;

a color conversion layer located on a surface of the LED pixels, wherein the color conversion layer converts the emitted light into colors;

a lens that, in response to receiving light generated by the LED display, projects the emitted light corresponding to a first color, a second color, and a third color of the colors onto a first location, a second location, or a third location of a projection surface respectively, thereby directing, to the first location, the second location, or the third location, a magnified, an enlarged or a focused version of the emitted light on the projection surface; and a controller, coupled to the LED display on the substrate, that controls respective states of the LED pixels.

2. The device of claim 1, wherein the color conversion layer comprises a plurality of color conversion layers comprising a color conversion material that is excited in response to the controller applying a current to an LED pixel of the LED pixels and the LED pixel emitting the light.

3. The device of claim 2, wherein the plurality of color conversion layers further comprises at least one of a phosphor powder, a fluorescent material, a quantum dot, or a conversion film.

4. The device of claim 2, wherein the LED pixels are configured to emit light at a determined wavelength, and wherein the color conversion layer of the plurality of color conversion layers is excited by the emitted light at the determined wavelength.

5. The device of claim 2, wherein the plurality of color conversion layers is located on a first side of at least one of the LED pixels.

6. The device of claim 2, wherein the plurality of color conversion layers comprises a shape corresponding to a shape of the LED pixel of the LED pixels.

7. The device of claim 2, wherein the surface of the LED display on the substrate further comprises cavities configured to receive the color conversion material.

8. The device of claim 2, wherein the LED pixels emit light at an ultraviolet wavelength and the plurality of color conversion layers is excited by the light at the ultraviolet wavelength.

9. The device of claim 8, wherein the plurality of color conversion layers comprises a red color conversion layer attached to a first LED pixel, a green color conversion layer attached to a second LED pixel, and a blue conversion material attached to a third LED pixel of the LED pixels.

10. The device of claim 2, wherein the LED display on the substrate generates the light at a defined wavelength to produce first light at the first color and wherein the color conversion material alters second light from at least one LED pixel of the LED pixels resulting in an altered light such that the altered light is a disparate color from the first color.

11. The device of claim 10, wherein the first color is blue and the color conversion material alters the second light to produce the altered light of at least a red color or a green color.

12. The device of claim 1, further comprising a passive matrix programmed display that comprises a passive matrix driving substrate.

13. The device of claim 12, wherein a polarity of the LED pixels is aligned in an array, negative electrodes of the LED pixels that are in a row of the array are coupled together, positive electrodes of the LED pixels in a column are coupled together, and, in response to current applied between a determined row and a determined column, a set of the LED pixels connecting between the determined row and the determined column emits light.

14. The device of claim 1, further comprising an active matrix programmed display that comprises an active matrix driving substrate.

15. The device of claim 14, wherein a polarity of the LED pixels is aligned in an array, respective negative electrodes of the LED pixels are coupled together, and respective positive electrodes of the LED pixels are coupled to an output of the active matrix driving substrate.

16. The device of claim 14, further comprising a plurality of driving circuits associated with respective ones of the LED pixels.

17. The device of claim 16, wherein the plurality of driving circuits comprises a plurality of transistors and capacitors with structures comprising at least one of an analog driver, a current mirror, a current ratio component, or a pulse-width modulation component.

18. The device of claim 17, wherein the plurality of transistors comprises at least one of: a p-channel Metal Oxide Semiconductor (PMOS) transistor, an n-channel Metal Oxide Semiconductor (NMOS) transistor, an n-type amorphous silicon Thin Film Transistor (n-type a-Si TFT), a p-type amorphous silicon Thin Film Transistor (p-type a-Si TFT), an n-type poly crystalline silicon Thin Film Transistor (n-type p-Si TFT), a p-type poly crystalline silicon Thin Film Transistor (p-type p-Si TFT), an n-type Silicon On Insulator (SOI) transistor, or a p-type SOI transistor.

19. The device of claim 14, further comprising a layer of the substrate on which components of the active matrix display are mounted, wherein the layer of the substrate comprises at least one material selected from a group comprising single crystal silicon, silicon on insulator (SOI), Quartz, and glass.

20. The device of claim 1, wherein the substrate comprises at least one material selected from a group comprising GaAs, SiC, Semi-insulating GaAs, Sapphire, and Quartz.

21. The device of claim 1, wherein the controller is configured to alter, based on a selected image, the respective states of the LED pixels to generate an image.

22. The device of claim 21, further comprising a projection component that, in response to receiving the image, projects the image on the projection surface.

23. The device of claim 22, wherein the projection surface comprises a display surface that receives the image on a first surface and displays the image on a second surface, and wherein the second surface is opposite the first surface.

24. A method, comprising:

altering, by a device, states of a group of light-emitting diode (LED) pixels disposed on a substrate between a first state defined as an on state and a second state defined as an off state, wherein the on state corresponds to emitting light by the group of LED pixels and the off state corresponds to an absence of emitting light by the group of LED pixels;

converting, by the device, respective lights emitted by the group of LED pixels in the on state to respective colors; and initiating, by the device, generation of an image corresponding to a first color, a second color, or a third color of the respective colors during the on state, wherein the image is magnified, enlarged, or focused onto a first location, a second location, or a third location on a projection surface based on whether the image corresponding to the first color, the second color, or the third color is initiated.

25. The method of claim 24, further comprising, based on the altering of the states, exciting, by the device, a color conversion material located on at least one of the LED pixels of the group of LED pixels.

26. The method of claim 25, wherein the color conversion material is attached to the at least one LED pixel by at least one process selected from a group of processes comprising spin coating, dispensing, deposition, plating, evaporating and pasting.

27. The method of claim 25, further comprising:

based on the initiating the generation of the image and the color conversion material, determining, by the device, a wavelength of light for emission by a selected LED pixel of the group of LED pixels.

28. The method of claim 24, wherein the altering of the states of the group of LED pixels further comprises:

altering a target level of current supplied to the group of LED pixels.

29. A device, comprising:

a plurality of substrates comprising a plurality of arrays of light-emitting diodes (LEDs) respectively, wherein a first array of the plurality of arrays of LEDs emits first light representing a first color, a second array of the plurality of arrays of LEDs emits second light representing a second color, and a third array of the plurality of arrays of LEDs emits third light representing a third color, and wherein the first color, the second color, and the third color are different colors;

a lens that, in response to receiving respective lights generated by the plurality of arrays of LEDs, projects the first light, the second light, and the third light onto a first location, a second location, and a third location of a projection surface respectively in accordance with a time schedule, resulting in a magnified, an enlarged or a focused version of the first light, the second light, and the third light being directed onto the projection surface; and a processor, coupled to a first plurality of LEDs and a second plurality of LEDs, that is configured to selectively apply a charge to a plurality of LEDs comprising the first plurality of LEDs and the second plurality of LEDs.

30. The device of claim 29, further comprising:

a focusing component that receives the respective lights from the plurality of arrays of LEDs and focuses the respective lights into an image.

31. The device of claim 30, further comprising:

a current source that supplies a target level of current to the plurality of arrays of LEDs based on a target light-emitting brightness value.

32. The device of claim 29, further comprising a set of lenses, associated with respective substrates of the plurality of substrates, that receive the respective lights generated by the plurality of arrays of LEDs of the respective substrates.

33. The device of claim 29, further comprising:

the projection surface that, in response to receiving the respective lights from the plurality of arrays of LEDs of the plurality of substrates, displays the light.

34. The device of claim 29, wherein each array of the plurality of arrays of LEDs comprises monochromatic LEDs having a disparate associated color in comparison to each other color of each other array.

* * * * *